US008682221B2

(12) United States Patent
Ichikawa et al.

(10) Patent No.: US 8,682,221 B2
(45) Date of Patent: Mar. 25, 2014

(54) DISCHARGER AND IMAGE FORMING APPARATUS

(75) Inventors: Yuzo Ichikawa, Kanagawa (JP); Tomoya Ichikawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 129 days.

(21) Appl. No.: 13/306,594

(22) Filed: Nov. 29, 2011

(65) Prior Publication Data

US 2012/0257905 A1 Oct. 11, 2012

(30) Foreign Application Priority Data

Apr. 11, 2011 (JP) ..... 2011-087747

(51) Int. Cl.
*G03G 15/02* (2006.01)

(52) U.S. Cl.
USPC ..... 399/171; 399/115

(58) Field of Classification Search
USPC ..... 399/115, 171
See application file for complete search history.

(56) References Cited

U.S. PATENT DOCUMENTS

| | | | | |
|---|---|---|---|---|
| 2005/0053397 | A1* | 3/2005 | Sekovski et al. | 399/171 |
| 2010/0158558 | A1* | 6/2010 | Hano | 399/100 |
| 2010/0221043 | A1* | 9/2010 | Gotoda et al. | 399/171 |
| 2011/0058844 | A1* | 3/2011 | Tanaka et al. | 399/100 |

FOREIGN PATENT DOCUMENTS

| | | | |
|---|---|---|---|
| JP | 2006-091456 | A | 4/2006 |
| JP | 2010-175725 | A | 8/2010 |
| JP | 2011-059234 | A | 3/2011 |

* cited by examiner

*Primary Examiner* — Benjamin Schmitt
(74) *Attorney, Agent, or Firm* — Sughrue Mion, PLLC

(57) ABSTRACT

A discharger includes a discharging member that faces a member to be charged and discharges electricity by applying voltage; and a grid member that is disposed between the discharging member and the member to be charged and regulates electric discharge from the discharging member. The grid member has holes with a predetermined shape and extending through the grid member from the discharging member toward the member to be charged, and has a first region with the holes arranged at a first inclination angle, a second region with the holes arranged at a second inclination angle, and a boundary between the first and second regions and extending in the extending direction of the discharging member. When the first region is symmetrically projected onto the second region with respect to the boundary, an arrangement pattern of the holes in the first region and an arrangement pattern of the holes in the second region are positionally displaced relative to each other.

20 Claims, 15 Drawing Sheets

DISCHARGER AND IMAGE FORMING APPARATUS

CROSS-REFERENCE TO RELATED APPLICATIONS

This application is based on and claims priority under 35 USC 119 from Japanese Patent Application No. 2011-087747 filed Apr. 11, 2011.

BACKGROUND

(i) Technical Field

The present invention relates to dischargers and image forming apparatuses.

SUMMARY

According to an aspect of the invention, there is provided a discharger including a discharging member and a grid member. The discharging member is disposed facing a member to be charged and discharges electricity by applying voltage thereto. The grid member is disposed between the discharging member and the member to be charged and regulates electric discharge from the discharging member when voltage is applied between the grid member and the discharging member. The grid member has multiple holes with a predetermined shape. The holes extends through the grid member from the discharging member toward the member to be charged. The grid member has a first region in which the holes with the predetermined shape are arranged at a first inclination angle inclined relative to the extending direction of the discharging member, a second region in which the holes with the predetermined shape are arranged at a second inclination angle that is different from the first inclination angle, and a boundary disposed between the first region and the second region and extending in the extending direction of the discharging member. When the first region is symmetrically projected onto the second region with respect to the boundary, an arrangement pattern of the holes in the first region and an arrangement pattern of the holes in the second region are positionally displaced relative to each other.

BRIEF DESCRIPTION OF THE DRAWINGS

Exemplary embodiment(s) of the present invention will be described in detail based on the following figures, wherein.

DETAILED DESCRIPTION

Figure 1:
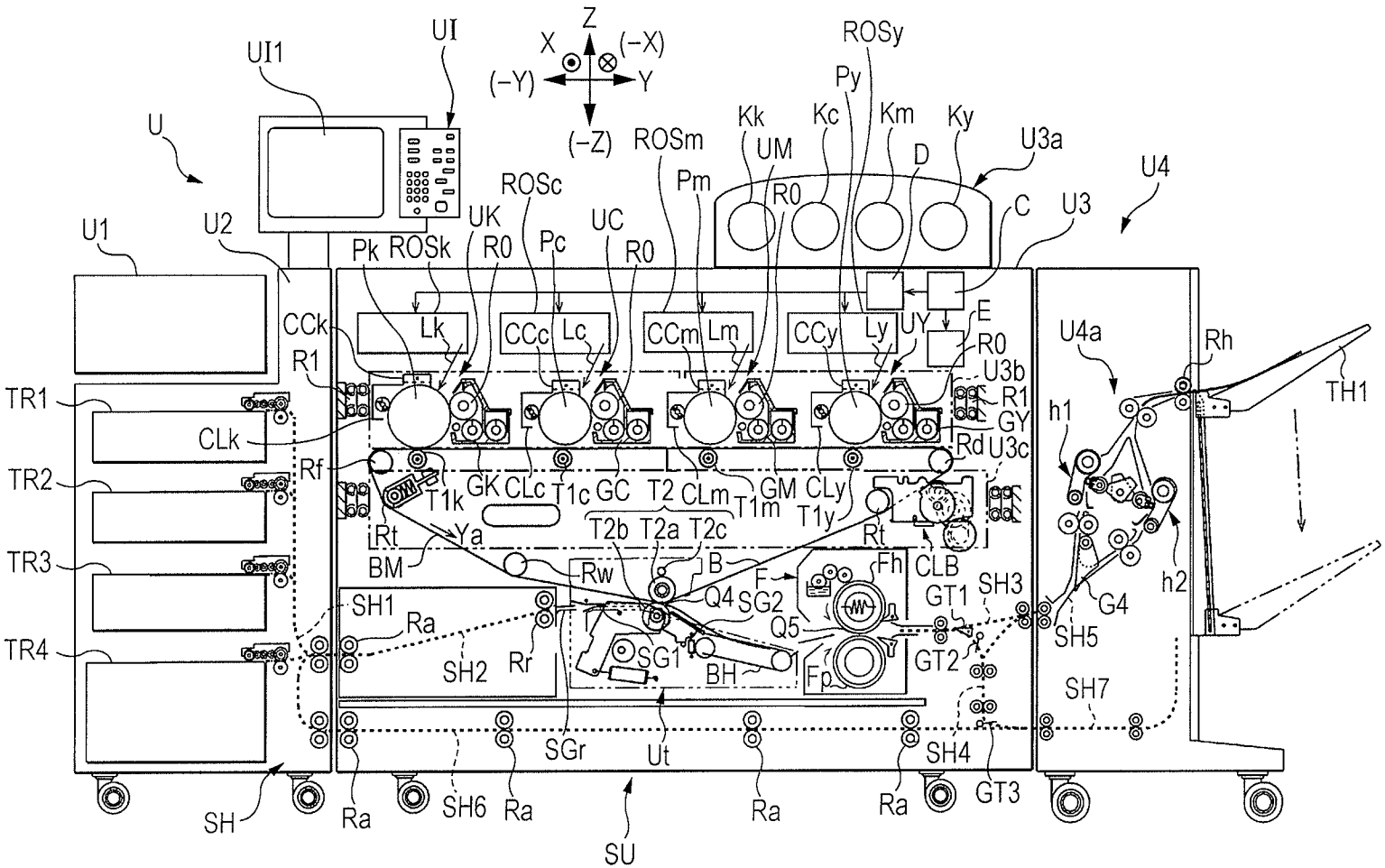
FIG. 1 is an overall view of an image forming apparatus according to a first exemplary embodiment of the present invention.

Although exemplary embodiments of the present invention will be described below with reference to the drawings, the present invention is not to be limited to the following exemplary embodiments.

In order to provide an easier understanding of the following description, the front-rear direction will be defined as "X-axis direction" in the drawings, the left-right direction will be defined as "Y-axis direction", and the up-down direction will be defined as "Z-axis direction". Moreover, the directions or the sides indicated by arrows X, −X, Y, −Y, Z, and −Z are defined as forward, rearward, rightward, leftward, upward, and downward directions, respectively, or as front, rear, right, left, upper, and lower sides, respectively.

Furthermore, in each of the drawings, a circle with a dot in the center indicates an arrow extending from the far side toward the near side of the plane of the drawing, and a circle with an "x" therein indicates an arrow extending from the near side toward the far side of the plane of the drawing.

In the drawings used for explaining the following description, components other than those necessary for providing an easier understanding of the description are omitted where appropriate.

First Exemplary Embodiment

FIG. 1 is an overall view of an image forming apparatus according to a first exemplary embodiment of the present invention.

In FIG. 1, an image forming apparatus U includes a user interface UI serving as an example of an operating section, an image input device U1 serving as an example of an image reader, a feeding device U2, an image recording device U3, which is an example of an image forming apparatus body and serves as an example of a detachable member, and a sheet processing device U4.

The user interface UI includes input keys serving as an example of an input section, such as a copy start key and a numerical keypad, and a display UI1.

The image input device U1 is constituted of an image scanner serving as an example of an image reader. In FIG. 1, the image input device U1 reads a document (not shown) and converts it into image information, and then inputs the image information to the image recording device U3.

The feeding device U2 includes feed trays TR1 to TR4 serving as an example of multiple feeders, and a feed path SH1 along which recording paper S serving as an example of a medium accommodated in each of the feed trays TR1 to TR4 is transported.

In FIG. 1, the image recording device U3 includes an image recorder that records an image onto the recording paper S transported from the feeding device U2, a toner dispenser U3*a*, a sheet transport path SH2, a sheet output path SH3, a sheet inversion path SH4, and a sheet circulation path SH6. The image recorder will be described in detail later.

The image recording device U3 further includes a controller C, a laser driving circuit D serving as an example of a driving circuit for a latent-image writing unit controlled by the controller C, and a power circuit E controlled by the controller C. The laser driving circuit D controlled by the controller C outputs laser driving signals according to the image information for yellow (Y), magenta (M), cyan (C), and black (K) colors input from the image input device U1 to latent-image forming units ROSy, ROSm, ROSc, and ROSk for the respective colors at a predetermined timing.

A drawer component U3*b* for image forming units is supported below the latent-image forming units ROSy, ROSm, ROSc, and ROSk by a pair of left and right guide members R1 and R1 in a movable manner between an ejected position at which the drawer component U3*b* is ejected to the front of the image recording device U3 and a mounted position at which the drawer component U3*b* is mounted inside the image recording device U3.

Figure 2:
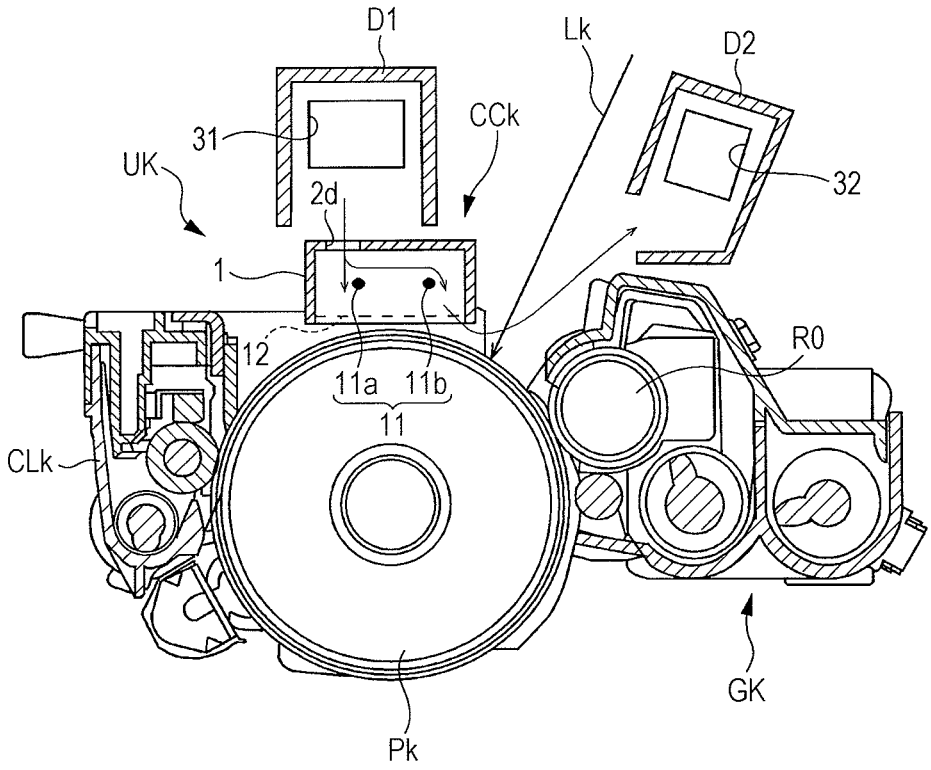
FIG. 2 illustrates a visible-image forming device having an image bearing unit and a developing unit.

FIG. 2 illustrates a visible-image forming device having an image bearing unit and a developing unit.

In FIGS. 1 and 2, a black image bearing unit UK includes a photoconductor drum Pk, which is an example of an image bearing member and serves as an example of a member to be charged, a charger CCk serving as an example of a discharger, and a photoconductor cleaner CLk serving as an example of an image-bearing-member cleaner. In the first exemplary embodiment, the charger CCk is constituted of a charging unit that is detachable from the image recording device U3. Likewise, image bearing units UY, UM, and UC for the remaining colors Y, M, and C respectively include photoconductor drums Py, Pm, and Pc, chargers CCy, CCm, and CCc serving as an example of dischargers, and photoconductor cleaners CLy, CLm, and CLc. In the first exemplary embodiment, the photoconductor drum Pk for the K color, which is frequently used and thus often experiences surface abrasion, is given a larger diameter than the photoconductor drums Py, Pm, and Pc for the remaining colors so as to allow for high-speed rotation and a longer lifespan.

The image bearing units UY, UM, UC, and UK and developing units GY, GM, GC, and GK having developing rollers R0 constitute toner-image forming members UY+GY, UM+GM, UC+GC, and UK+GK, respectively. The image bearing units UY, UM, UC, and UK and the developing units GY, GM, GC, and GK are detachably attached to the drawer component U3*b*.

In FIG. 1, the photoconductor drums Py, Pm, Pc, and Pk are electrostatically charged by the chargers CCy, CCm, CCc, and CCk, respectively, and electrostatic latent images are subsequently formed on the surfaces thereof by laser beams Ly, Lm, Lc, and Lk output as an example of latent-image write-in light from the latent-image forming units ROSy, ROSm, ROSc, and ROSk. The electrostatic latent images on the surfaces of the photoconductor drums Py, Pm, Pc, and Pk are developed into Y, M, C, and K toner images by the developing units GY, GM, GC, and GK.

The toner images on the surfaces of the photoconductor drums Py, Pm, Pc, and Pk are sequentially superposed and transferred onto an intermediate transfer belt B, which is an example of an image bearing member and serves as an example of an intermediate transfer body, by first transfer rollers T1*y*, T1*m*, T1*c*, and T1*k* serving as an example of a first transfer unit, whereby a multi-color image, that is, a color image, is formed on the intermediate transfer belt B. The color image formed on the intermediate transfer belt B is transported to a second transfer region Q4 serving as an example of an image recording position.

In the case of black image data only, the photoconductor drum Pk and the developing unit GK for the black (K) color are used so that only a black toner image is formed.

After the first transfer process, residual toners on the surfaces of the photoconductor drums Py, Pm, Pc, and Pk are cleaned by the cleaners CLy, CLm, CLc, and CLk for the photoconductor drums.

A drawer component U3*c* for the intermediate transfer body is supported below the drawer component U3*b* in a movable manner between an ejected position at which the drawer component U3*c* is ejected to the front of the image recording device U3 and a mounted position at which the drawer component U3*c* is mounted inside the image recording device U3. In the drawer component U3*c*, a belt module BM serving as an example of an intermediate transfer unit is supported in a vertically movable manner between a lifted position at which the belt module BM is brought into contact with the lower surfaces of the photoconductor drums Py, Pm, Pc, and Pk and a lowered position at which the belt module BM is lowered away from the lower surfaces.

The belt module BM includes the aforementioned intermediate transfer belt B, belt support rollers Rd, Rt, Rw, Rf, and T2*a* serving as an example of intermediate-transfer-body support members, and the aforementioned first transfer rollers T1*y*, T1*m*, T1*c*, and T1*k*. The belt support rollers Rd, Rt, Rw, Rf, and T2*a* include a belt driving roller Rd serving as an example of a driving member, a tension roller Rt serving as an example of a tension applying member, a working roller Rw serving as an example of a meander prevention member, multiple idler rollers Rf serving as an example of driven members, and a backup roller T2*a* serving as an example of an opposing member disposed opposite the second transfer region Q4. The intermediate transfer belt B is supported by the belt support rollers Rd, Rt, Rw, Rf, and T2*a* in a rotatable manner in a direction indicated by an arrow Ya.

A second transfer unit Ut is disposed below the backup roller T2*a*. The second transfer unit Ut includes a second transfer roller T2*b* serving as an example of a second transfer member. The second transfer roller T2*b* is disposed in a movable manner toward and away from the backup roller T2*a* with the intermediate transfer belt B interposed therebetween, and the second transfer region Q4 is formed in an area where the second transfer roller T2*b* comes into contact with the intermediate transfer belt B. The backup roller T2*a* is in contact with a contact roller T2*c* serving as an example of a contact member for applying voltage. The rollers T2*a* to T2*c* constitute a second transfer unit T2.

A second transfer voltage having the same polarity as the charge polarity of the toners is applied, at a predetermined timing, to the contact roller T2*c* from the power circuit controlled by the controller C.

The sheet transport path SH2 is disposed below the belt module BM. The recording paper S fed from the feed path SH1 of the feeding device U2 is transported to the sheet transport path SH2. Then, a registration roller Rr serving as an example of a feed adjustment member transports the recording paper S to the second transfer region Q4 via pre-transfer medium guide members SGr and SG1 in accordance with the timing at which the toner images are to be transferred to the second transfer region Q4.

The toner images on the intermediate transfer belt B are transferred onto the recording paper S by the second transfer unit T2 as the recording paper S travels through the second transfer region Q4. In the case of a full-color image, the toner images superposed and first-transferred on the surface of the intermediate transfer belt B are collectively second-transferred onto the recording paper S.

After the second transfer process, the intermediate transfer belt B is cleaned by a belt cleaner CLB serving as an example of an intermediate-transfer-body cleaner.

The first transfer rollers T1*y*, T1*m*, T1*c*, and T1*k*, the intermediate transfer belt B, the second transfer unit T2, and the belt cleaner CLB constitute a transfer unit T1+B+T2+CLB that transfers the images on the surfaces of the photoconductor drums Py, Pm, Pc, and Pk onto the recording paper S.

The recording paper S having the superposed toner image second-transferred thereon is transported to a fixing unit F via a post-transfer medium guide member SG2 and a sheet transport belt BH serving as an example of a pre-fixation medium guide member. The fixing unit F includes a heating roller Fh serving as an example of a thermal fixing member and a pressing roller Fp serving as an example of a pressure fixing member. A fixing region Q5 is formed in an area where the heating roller Fh and the pressing roller Fp come into contact with each other.

The toner image on the recording paper S is thermally fixed thereon by the fixing unit F as the recording paper S travels through the fixing region Q5.

The toner-image forming members UY+GY, UM+GM, UC+GC, and UK+GK, the transfer unit T1+B+T2+CLB, and the fixing unit F constitute the image reader in the first exemplary embodiment that records an image on the recording paper S.

A first gate GT1 serving as an example of a transport-path switching member is provided downstream of the fixing unit F. The first gate GT1 selectively switches the transport path of the recording paper S, transported along the sheet transport path SH2 and having the image thermally fixed thereon in the fixing region Q5, to either the sheet inversion path SH4 or the sheet output path SH3 in the sheet processing device U4. The recording paper S transported to the sheet output path SH3 is transported to a sheet transport path SH5 in the sheet processing device U4.

A curl correction unit U4*a* serving as an example of a curve correction unit is disposed at an intermediate location of the sheet transport path SH5. A second gate G4 serving as an example of a transport-path switching member is disposed in the sheet transport path SH5. The second gate G4 transports the recording paper S transported from the sheet output path SH3 of the image recording device U3 to either a first curl correction member h1 or a second curl correction member h2, depending on the direction in which the recording paper S is curved or curled. The curl of the recording paper S transported to the first curl correction member h1 or the second curl correction member h2 is corrected as the recording paper S travels through the curl correction member. The recording paper S with its curl corrected is output by a sheet output roller Rh serving as an example of a sheet output member toward a sheet output tray TH1 serving as an example of a sheet output section of the sheet processing device U4 while the image fixed surface of the paper is faced upward.

The recording paper S transported toward the sheet inversion path SH4 of the image recording device U3 by the first gate GT1 travels while pushing over a transport-direction regulation member constituted of an elastic thin-film member, that is, a mylar gate GT2, so as to be transported to the sheet inversion path SH4 of the image recording device U3.

A downstream end of the sheet inversion path SH4 in the image recording device U3 is connected to the sheet circulation path SH6 and a sheet inversion path SH7, and another mylar gate GT3 is disposed at the connection between the sheet inversion path SH4, the sheet circulation path SH6, and the sheet inversion path SH7. The recording paper S transported to the sheet inversion path SH4 via the first gate GT1 travels through the mylar gate GT3 so as to be transported toward the sheet inversion path SH7 in the sheet processing device U4. In a case where duplex printing is to be performed, the recording paper S transported along the sheet inversion path SH4 is transported to the sheet inversion path SH7 via the mylar gate GT3, and is subsequently transported in the reverse direction so as to be switched back. Then, the mylar gate GT3 regulates the transport direction so that the switched-back recording paper S is transported toward the sheet circulation path SH6. The recording paper S transported to the sheet circulation path SH6 is transported again to the second transfer region Q4 via the feed path SH1.

After the trailing edge of the recording paper S passes through the mylar gate GT2, the recording paper S transported along the sheet inversion path SH4 is switched back before passing through the mylar gate GT3. Then, the mylar gate GT2 regulates the transport direction of the recording paper S so that the recording paper S with its front and back faces in an inverted state is transported to the sheet transport path SH5. The inverted recording paper S has its curl corrected by the curl correction unit U4*a* and is subsequently output onto the sheet output tray TH1 in the sheet processing device U4 while the image fixed surface of the recording paper S is faced downward.

The components denoted by the reference characters SH1 to SH7 constitute a sheet transport path SH. Furthermore, the components denoted by the reference characters SH, Ra, Rr, Rh, SGr, SG1, SG2, BH, and GT1 to GT3 constitute a sheet transport unit SU.

Charger

Figure 3:
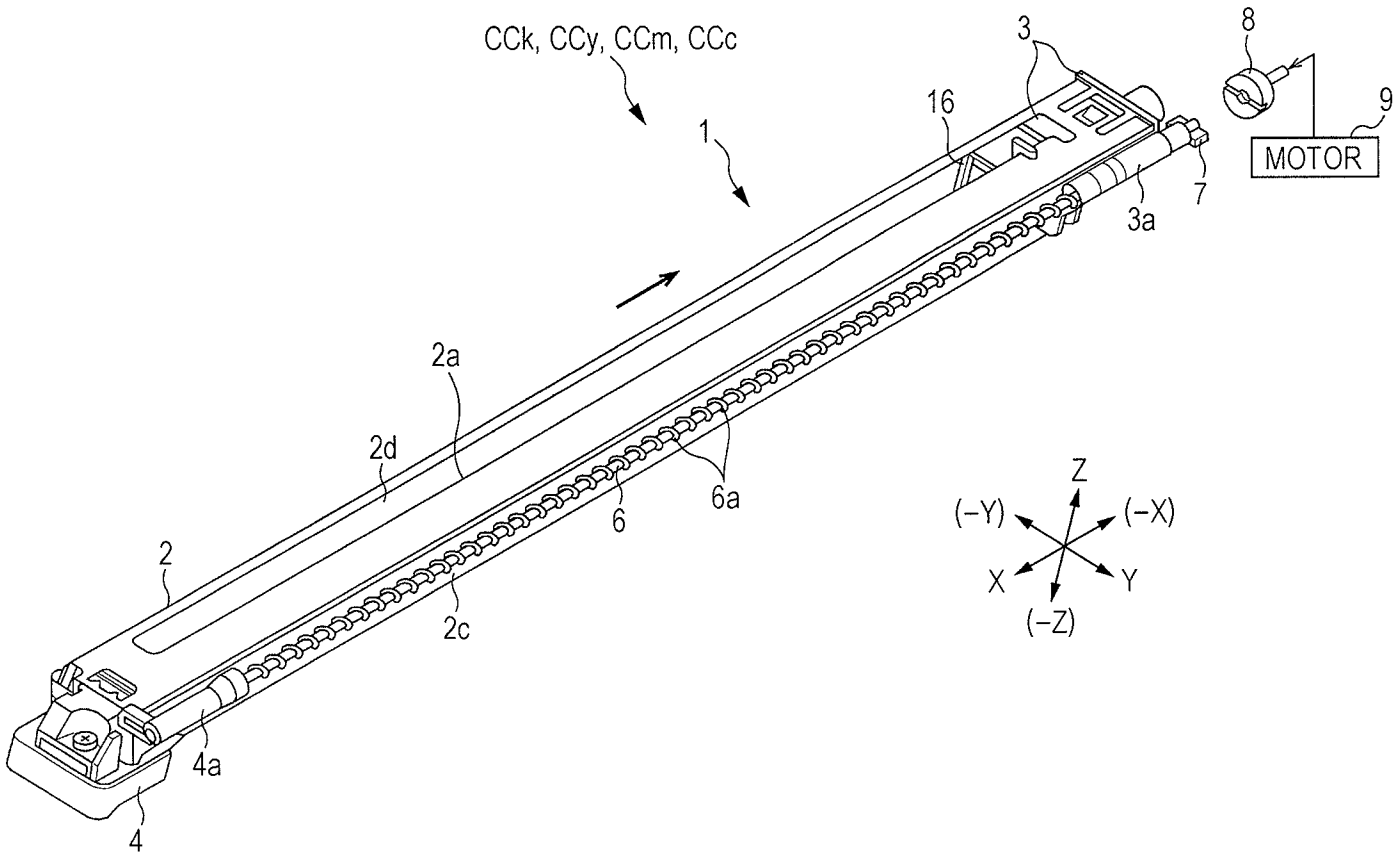
FIG. 3 is a perspective view of the charger according to the first exemplary embodiment of the present invention.

FIG. 3 is a perspective view of the charger according to the first exemplary embodiment of the present invention.

Figure 4:
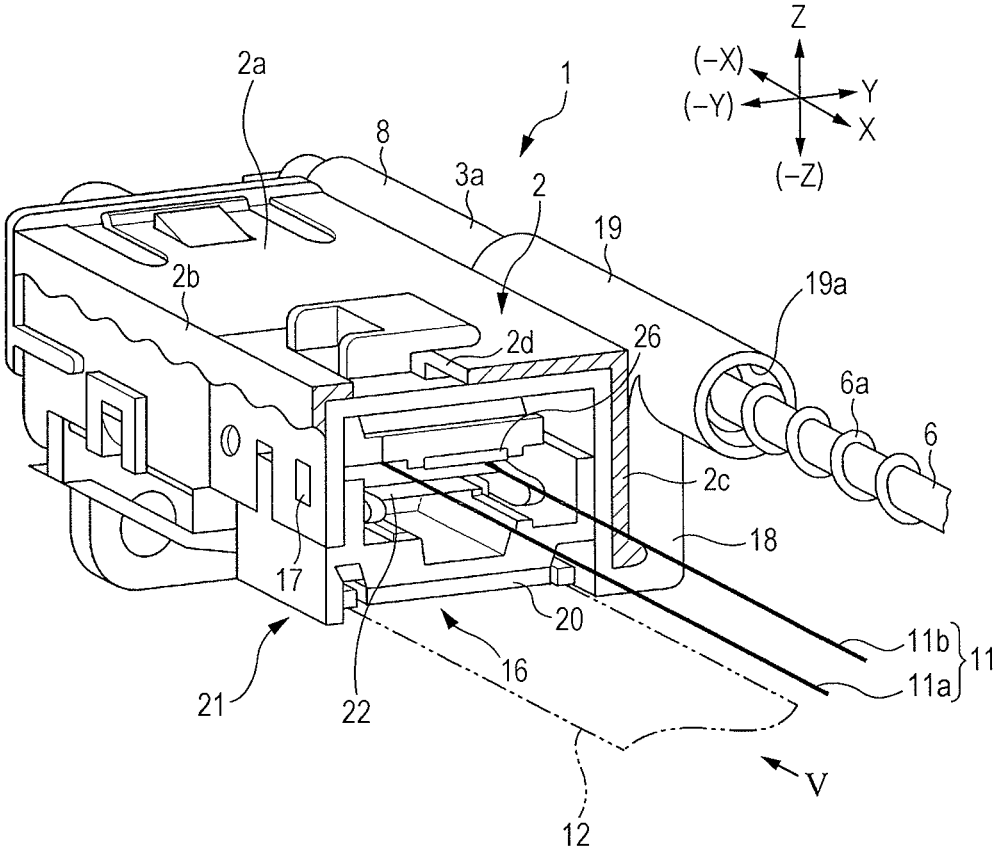
FIG. 4 is a cross-sectional view illustrating a relevant part of the charger according to the first exemplary embodiment of the present invention.

FIG. 4 is a cross-sectional view illustrating a relevant part of the charger according to the first exemplary embodiment of the present invention.

Figure 5:
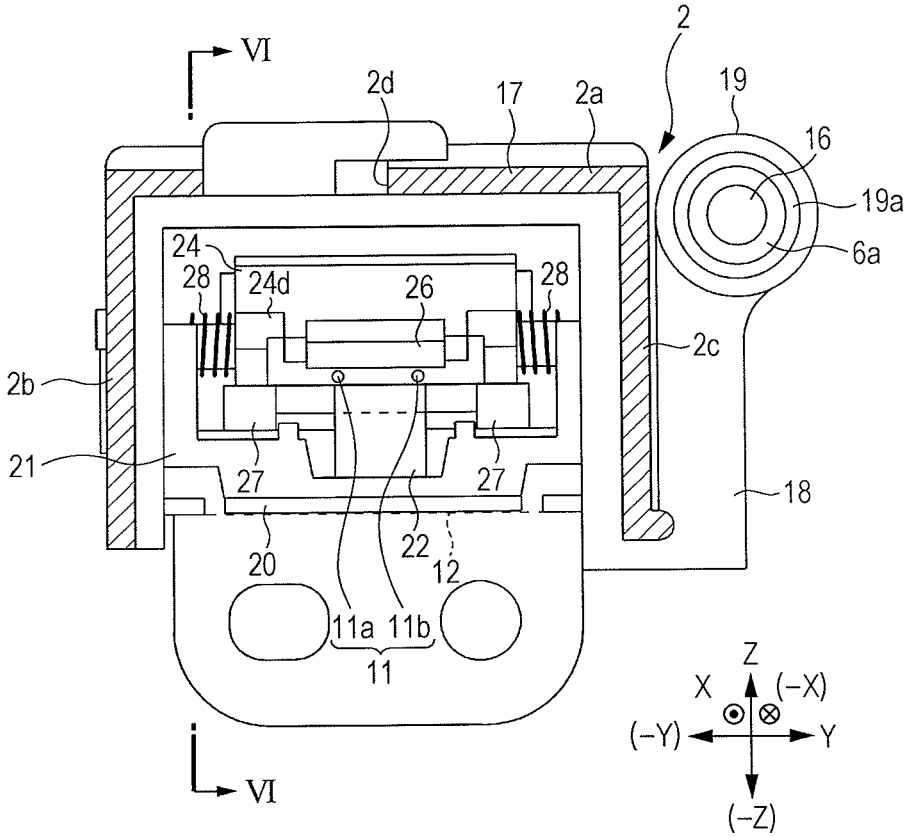
FIG. 5 is a diagram as viewed in a direction indicated by an arrow V in FIG. 4.

FIG. 5 is a diagram as viewed in a direction indicated by an arrow V in FIG. 4.

Figure 6:
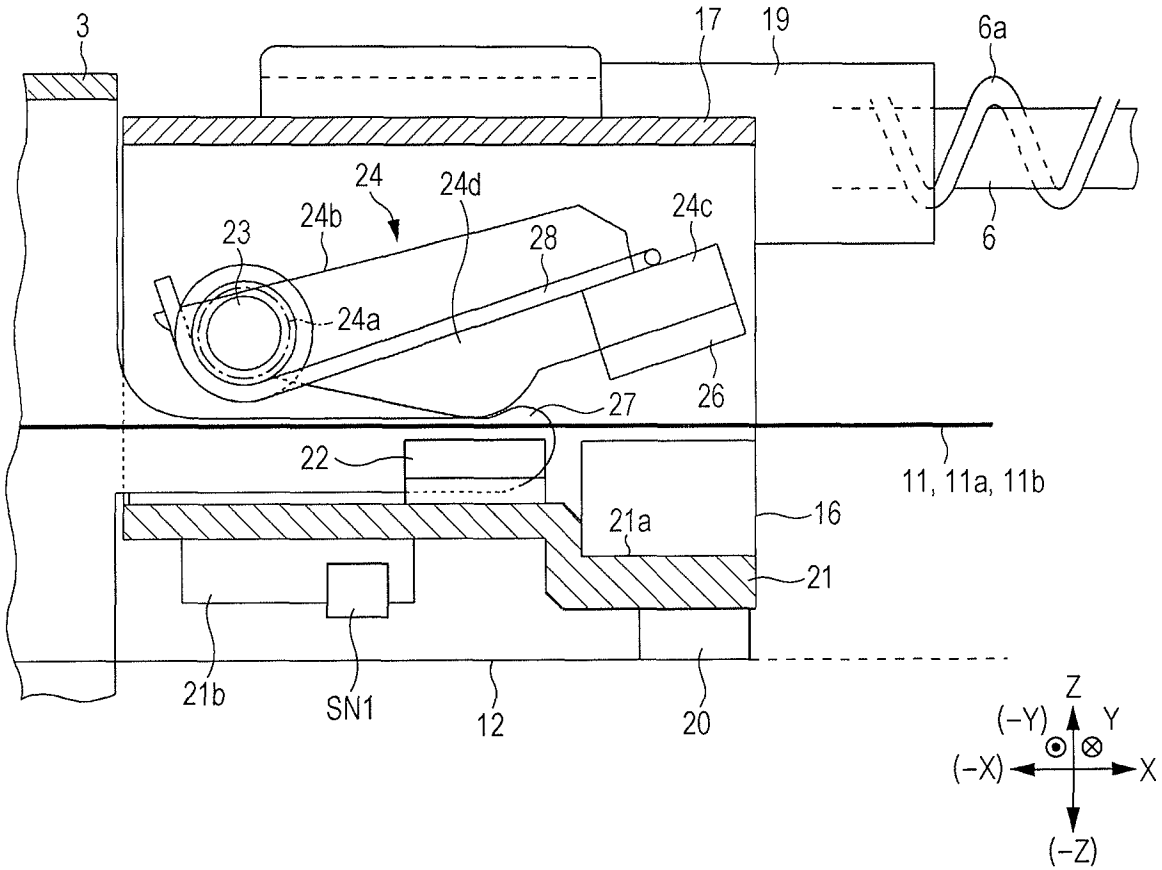
FIG. 6 is a cross-sectional view taken along line VI-VI in FIG. 5, illustrating a state where an electrode cleaner has moved from a reference position.

FIG. 6 is a cross-sectional view taken along line VI-VI in FIG. 5, illustrating a state where an electrode cleaner has moved from a reference position.

In FIG. 4, a part of a shield electrode is omitted for providing an easier understanding of the first exemplary embodiment of the present invention.

With regard to the following description of the charger according to the first exemplary embodiment, since the chargers CCy to CCk for the Y, M, C, and K colors have the same configuration, the charger CCk for the K color will be described in detail, and detailed descriptions of the chargers CCy to CCc for the remaining colors will be omitted.

In FIGS. 2, 3, and 4, the charger CCk according to the first exemplary embodiment includes a charger body 1 serving as an example of a discharger body and extending in the front-rear direction. The charger body 1 has a shield electrode 2 serving as an example of a second grid member and composed of a U-shaped electrically conductive metallic material extending in the front-rear direction and having a lower opening facing toward the photoconductor drum Pk. The shield electrode 2 has a plate-like upper wall 2*a* extending in the front-rear direction and plate-like left and right walls 2*b* and 2*c* extending downward from left and right sides of the upper wall 2*a*. A left portion of the upper wall 2*a* is provided with an opening 2*d* extending in the front-rear direction.

A rear end of the shield electrode 2 supports a rear-end block 3 serving as an example of a first-end member, and a front end of the shield electrode 2 supports a front-end block 4 serving as an example of a second-end member. Upper right portions of the rear-end block 3 and the front-end block 4 are provided with cylindrical shaft bearings 3*a* and 4*a* serving as an example of support members for a cleaning movable member and extending in the front-rear direction.

The shaft bearings 3*a* and 4*a* rotatably support a shaft 6 serving as an example of a rotatable member and extending in the front-rear direction. The outer peripheral surface of the shaft 6 is provided with a threaded section 6*a*. A rear end portion of the shaft 6 extends rearward through the shaft bearing 3*a* at the rear side and supports a driven coupling 7 serving as an example of a transmitted member. When the charger CCk is attached to the image recording device U3, the driven coupling 7 is supported in engagement with a driving coupling 8 serving as an example of a transmitting member rotatably supported by the image recording device U3. The driving coupling 8 is capable of transmitting a driving force from an electrode-cleaner motor 9 serving as an example of a driving source for an electrode cleaning member and supported by the image recording device U3 in a rotatable manner in forward and reverse directions.

Referring to FIGS. 2 to 6, a wire electrode 11 serving as an example of a discharging member and formed of wires extending in the front-rear direction is disposed within the charger body 1. The front and rear ends of the wire electrode 11 are supported by the blocks 3 and 4. The wire electrode 11 in the first exemplary embodiment has a pair of first wire 11*a* and second wire 11*b* that are disposed with a certain distance therebetween in the rotational direction of the surface of the photoconductor drum Pk and that extend parallel to the front-rear direction.

A grid electrode 12 having a grid pattern serving as an example of a grid member is supported in the lower opening of the shield electrode 2 between the wire electrode 11 and the photoconductor drum Pk, that is, in a charge region Q1 facing the photoconductor drum Pk. The grid electrode 12 is formed by perforating multiple vertically-extending through-holes in a electrically conductive thin-film material extending in the front-rear direction, which is the direction in which the wire electrode 11 extends. The front and rear ends of the grid electrode 12 are supported in a bridged manner between the blocks 3 and 4.

The electrodes 2, 11, and 12 receive discharge voltage from the power circuit E so that the surface of the photoconductor drum Pk is electrostatically charged by electrons released from the wire electrode 11 in accordance with a potential difference between the wire electrode 11 and the shield electrode 2 as well as between the wire electrode 11 and the grid electrode 12. In the first exemplary embodiment, a high voltage is applied to the wire electrode 11, and a voltage according to a target charge voltage for the surface of the photoconductor drum Pk is applied to the grid electrode 12. With the voltage applied to the grid electrode 12, the electric discharge of the wire electrode 11 is regulated so that the charge voltage for the surface of the photoconductor drum Pk is controlled.

Referring to FIGS. 4 to 6, the charger body 1 accommodates therein the wire electrode 11 and an electrode cleaner 16 serving as an example of a discharger cleaning member and disposed between the shield electrode 2 and the grid electrode 12. The electrode cleaner 16 has an angular-tube-shaped upper slider frame 17 having a lower opening and serving as an example of a first cleaning frame member. The upper slider frame 17 is composed of an insulating material and is disposed along the inner surface of the shield electrode 2. A lower right end of the upper slider frame 17 is provided with a U-shaped arm 18 extending around the lower edge of the right wall 2*c* of the shield electrode 2 and serving as an example of a connection section. An upper end of the arm 18 is provided with a cylindrical shaft through-hole 19 serving as an example of an interlocking section and through which the shaft 6 extends. The interior of the shaft through-hole 19 is provided with a threaded section 19*a* that is engaged with the threaded section 6*a* of the shaft 6. Therefore, when the shaft 6 rotates in the front or reverse direction, the arm 18 moves along the shaft 6 in the front-rear direction via the threaded sections 6*a* and 19*a*. In other words, the arm 18 moves forward away from or moves rearward toward a home position located at the rear end and serving as an example of a reference position, whereby the electrode cleaner 16 moves in the front-rear direction.

The shaft 6, the arm 18, and the shaft through-hole 19 constitute a cleaning movable member 6+18+19 according to the first exemplary embodiment.

A U-shaped lower slider frame 21 having an upper opening and serving as an example of a second cleaning frame member is supported below the upper slider frame 17. In FIG. 6, a front end of the lower slider frame 21 is provided with a grid cleaner support 21*a* that is depressed toward the grid electrode 12 disposed therebelow. The grid cleaner support 21*a* serves as an example of a third cleaning support. The lower surface of the grid cleaner support 21*a* supports a grid cleaner 20 serving as an example of a third cleaning section. The grid cleaner 20 is supported so as to face and be in contact with the grid electrode 12, and cleans the grid electrode 12 as the electrode cleaner 16 reciprocates in the front-rear direction. Although the grid cleaner 20 in the first exemplary embodiment is a so-called brush formed of base fabric with bristles, the grid cleaner 20 may alternatively be formed of any kind of material, such as a cloth-like member, so long as it can clean the grid electrode 12.

In FIG. 6, a lower wire cleaner 22 serving as an example of an electrode cleaning member and disposed facing the wire electrode 11 is supported above a midsection of the lower slider frame 21 in the front-rear direction. As shown in FIG. 6, when the electrode cleaner 16 is moved to the home position serving as an example of a reference position, the lower wire cleaner 22 is positioned away from the wire electrode 11.

Furthermore, the lower surface of the lower slider frame 21 is provided with a plate-like detected section 21*b* that extends downward. An optical sensor SN1 that serves as a detecting member is disposed at a position corresponding to the detected section 21*b* in the state where the electrode cleaner 16 is moved to the home position serving as an example of an initial position shown in FIG. 6. The optical sensor SN1 detects the detected section 21*b* so as to detect that the electrode cleaner 16 has moved to the home position.

Referring to FIGS. 5 and 6, left and right shaft portions 23 extending inward in the left-right direction are supported by the inner surface of the upper slider frame 17. An upper cleaner support 24 serving as an example of a first-cleaning-member support is disposed within the shaft portions 23. The upper cleaner support 24 includes a pair of left and right rotation center portions 24*a* rotatably supported by the shaft portions 23, a pair of left and right arm plate portions 24*b* serving as an example of connection portions and extending forward from the rotation center portions 24*a*, and a plate-like support body 24*c* that connects the front ends of the arm plate portions 24*b* and extends in the left-right direction. An upper wire cleaner 26 serving as an example of an electrode cleaning member and disposed facing the wire electrode 11 is supported by the lower surface of the support body 24*c*. The lower surface of each arm plate portion 24*b* is provided with a fan-shaped contact portion 24*d* that bulges downward. The contact portions 24*d* are contactable with a pair of left and right contact portions 27 extending into the electrode cleaner 16 from the rear-end block 3. Specifically, the contact portions 24*d* and the contact portions 27 are provided for keeping the upper wire cleaner 26 and the wire electrode 11 away from each other.

In the first exemplary embodiment, a torsion spring 28 serving as an example of a bias member that biases the upper cleaner support 24 in a direction for rotating the front end thereof downward, that is, in a direction for moving the upper wire cleaner 26 closer toward the wire electrode 11, is attached to each of the shaft portions 23.

Figure 7:
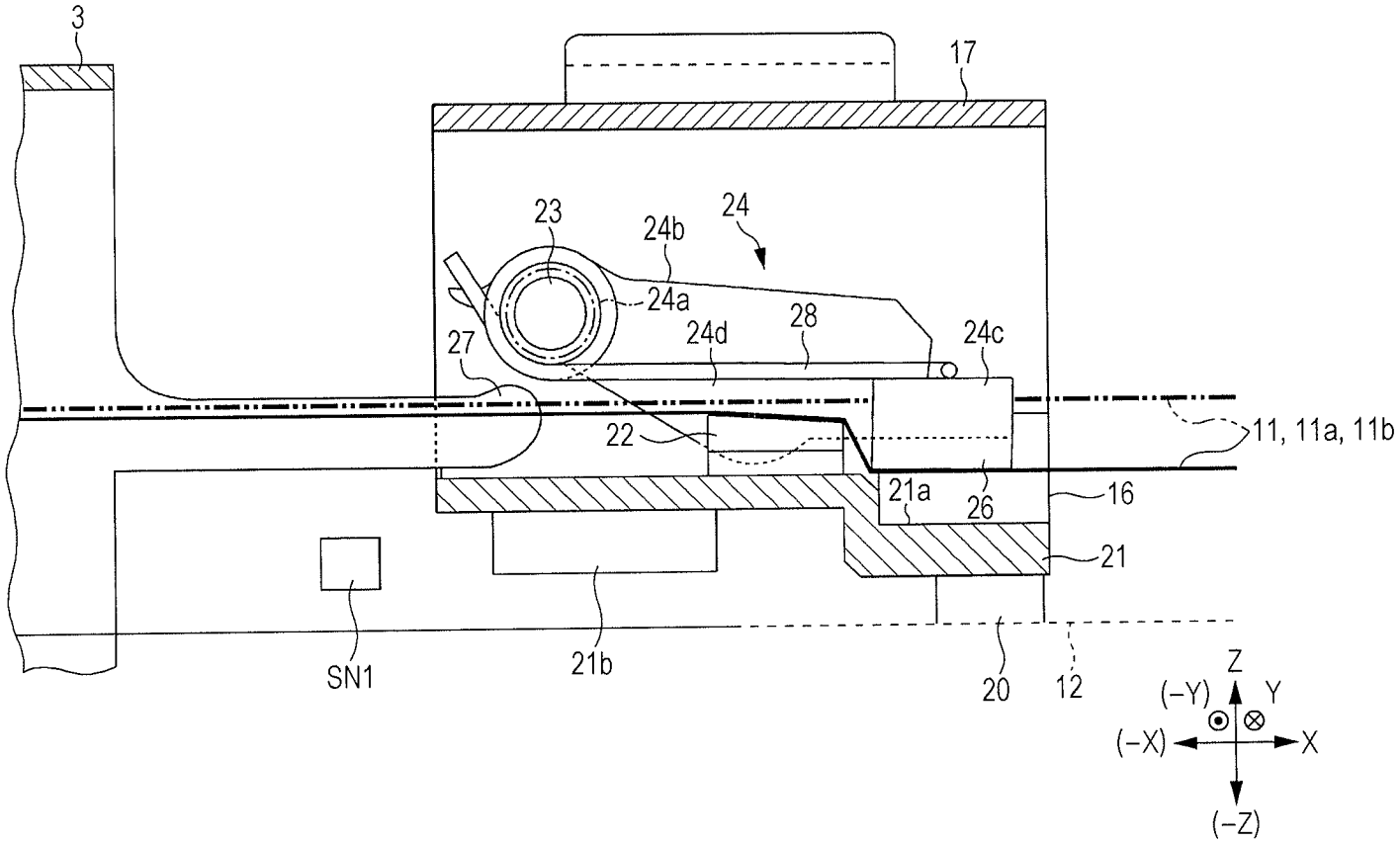
FIG. 7 illustrates a state where the electrode cleaner has moved forward from the state shown in FIG. 6.

FIG. 7 illustrates a state where the electrode cleaner 16 has moved forward from the state shown in FIG. 6.

At the reference position shown in FIG. 6, the contact portions 24*d* are in contact with the contact portions 27, and the torsion springs 28 are elastically deformed so that the wire electrode 11 and the upper wire cleaner 26 are positioned away from each other. Then, when the electrode cleaner 16 is moved forward by driving the electrode-cleaner motor 9, the contact portions 24*d* and the contact portions 27 are moved out of contact with each other, as shown in FIG. 7, so that the upper wire cleaner 26 is pressed onto the wire electrode 11 from above due to the weight of the upper cleaner support 24 and the elastic force of the torsion springs 28. At this time, the wire electrode 11 is pressed downward by the upper wire cleaner 26 so as to move downward relative to the position of the wire electrode 11 denoted by a dot-dash line corresponding to the reference position. Consequently, the lower surface of the wire electrode 11 comes into contact with the lower wire cleaner 22, so that a position shown in FIG. 7 in which the lower and upper wire cleaners 22 and 26 are in contact with the wire electrode 11 with a predetermined contact pressure is maintained due to the balance between the lower and upper wire cleaners 22 and 26 and the tension of the wire electrode 11. In the state where the lower and upper wire cleaners 22 and 26 are in contact with the wire electrode 11, the electrode cleaner 16 reciprocates in the front-rear direction so as to clean the wire electrode 11.

A method for detecting whether the electrode cleaner 16 has reached the front end of the charger CCk may be achieved by employing a freely-chosen method, such as using a sensor, a detailed description thereof will be omitted here. When the cleaning operation is completed, the electrode cleaner 16 returns to the home position.

The upper cleaner support 24, the contact portions 24*d*, the contact portions 27, and the torsion springs 28 constitute a cleaning contact mechanism 24+27+28 according to the first exemplary embodiment.

Referring to FIG. 2, in the image forming apparatus U according to the first exemplary embodiment, a first air channel D1 having an air outlet 31 is disposed above each of the chargers CCy to CCk, and a second air channel D2 having an air exhaust port 32 is disposed above each of the developing units GY to GK. A ventilator serving as an example of an ejecting unit (not shown) is disposed inside the image forming apparatus U. With the ventilator, air is made to flow outward through the air outlets 31 and travel through the interior of the chargers CCy to CCk via the openings 2*d*. Then, the air is made to flow to the air exhaust ports 32 together with contamination, such as a discharge product generated during the discharge process and removed by the electrode cleaner 16, and is purified by a purifier, such as a filter, before being ejected outward to the ambient environment. In the first exemplary embodiment, the openings 2*d* are located away from, that is, at the left side of, the air exhaust ports 32 so that the chargers CCy to CCk may be ventilated efficiently. Specifically, if the openings 2*d* are formed at the right side, air at the left side within the chargers CCy to CCk would be accumulated therein, making it difficult to ventilate the chargers CCy to CCk. In contrast, forming the openings 2*d* at the left side allows for efficient ventilation.

In the first exemplary embodiment, the cleaning operation for cleaning the wire electrode 11 and the grid electrode 12 by reciprocating the electrode cleaner 16 in the front-rear direction is performed in a state where each of the photoconductor drum Py to Pk is not electrostatically charged, that is, in a state where image forming operation is not performed. When the cleaning operation is being performed, that is, when the electrode cleaner 16 is being reciprocated, the ejecting unit is activated so that the contamination removed by the electrode cleaner 16 is drawn in by suction and ejected outward.

Although the image forming apparatus U according to the first exemplary embodiment is set to perform the cleaning operation every time the accumulative number of printed sheets reaches 1000 sheets as an example of a predetermined number of sheets, the cleaning operation may alternatively be performed at a freely-chosen time point, such as when the image forming operation is completed, when the power of the image forming apparatus U is turned off, or at a predetermined time.

Grid Electrode

Figure 8:
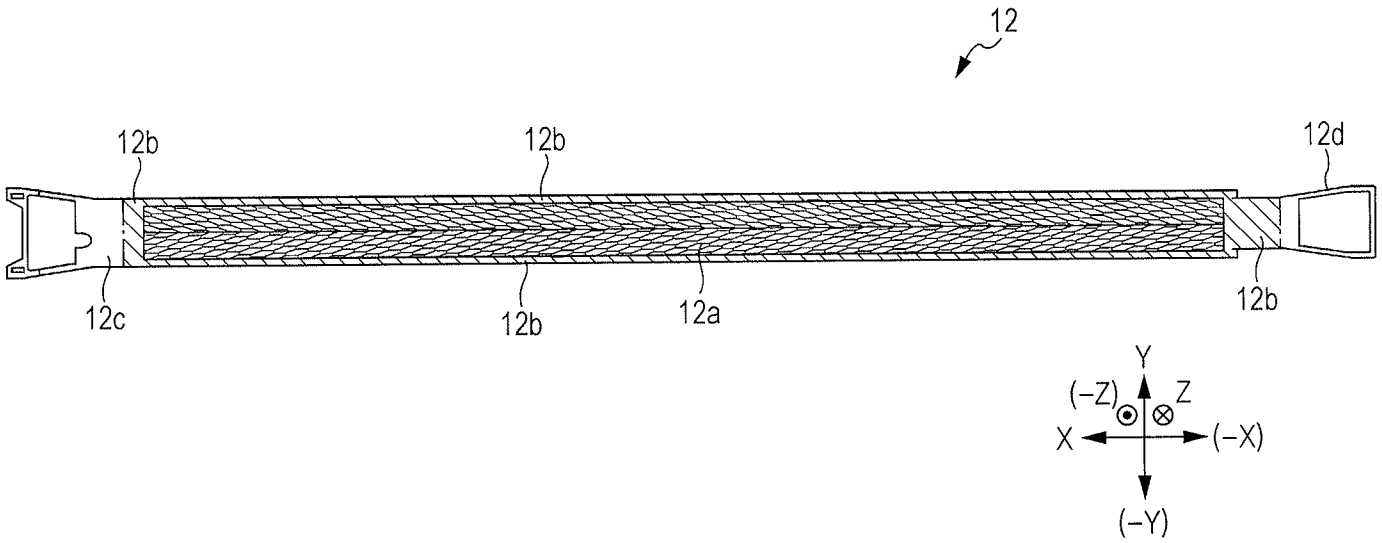
FIG. 8 illustrates a grid electrode in the first exemplary embodiment.

FIG. 8 illustrates the grid electrode 12 in the first exemplary embodiment.

In FIG. 8, the grid electrode 12 in the first exemplary embodiment includes a grid segment 12*a* in the middle, a frame segment 12*b* surrounding the grid segment 12*a*, a front supported segment 12*c* formed at the front side of the frame segment 12*b*, and a rear supported segment 12*d* formed at the rear side of the frame segment 12*b*. The grid electrode 12 in the first exemplary embodiment is bridged between the front-end block 4 and the rear-end block 3 with a predetermined tension and is supported at the front supported segment 12*c* and the rear supported segment 12*d*.

Figure 9:
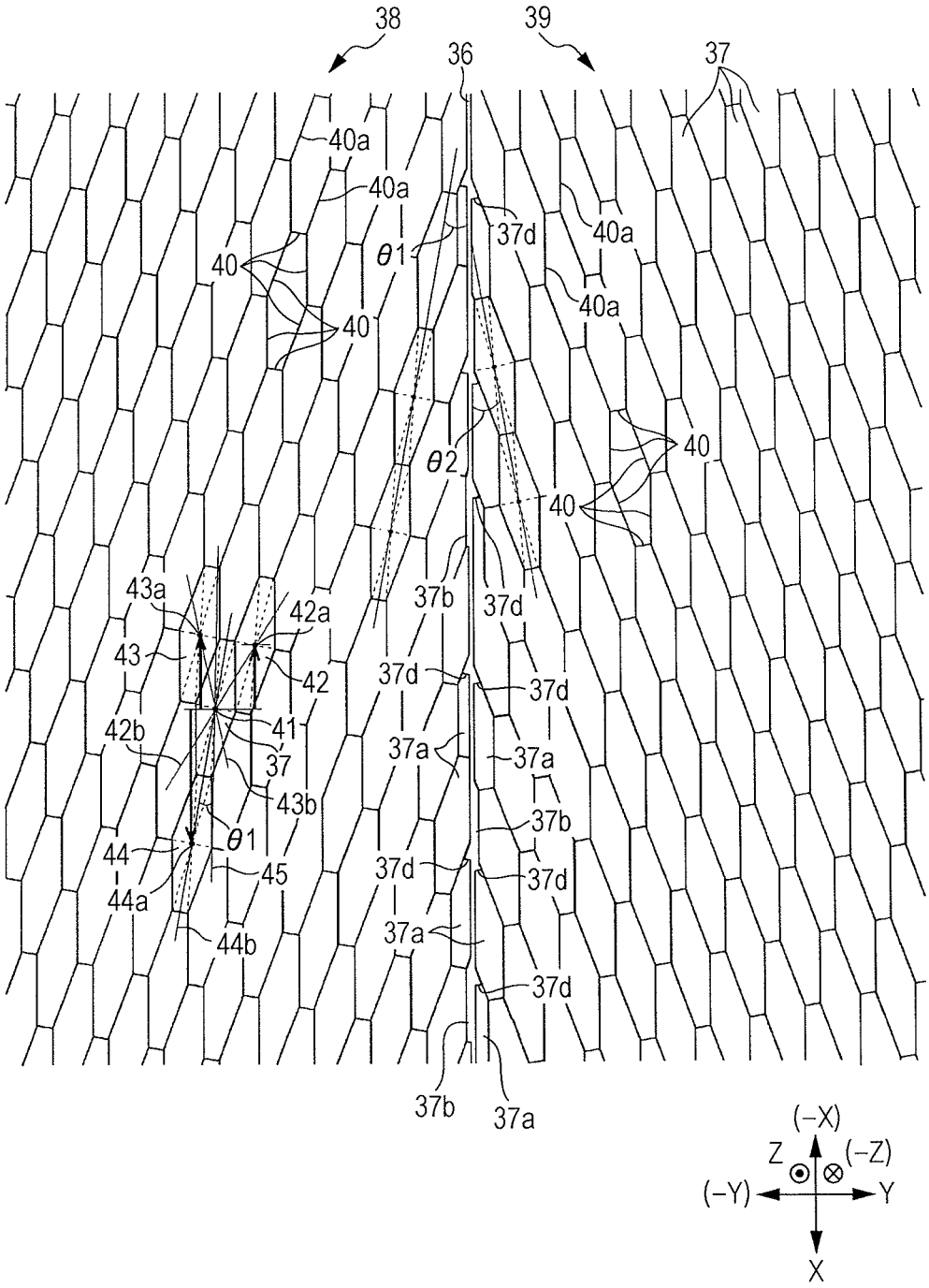
FIG. 9 is an enlarged view of a grid segment of the grid electrode in the first exemplary embodiment.

FIG. 9 is an enlarged view of the grid segment 12*a* of the grid electrode 12 in the first exemplary embodiment.

Referring to FIGS. 8 and 9, the grid segment 12*a* of the grid electrode 12 in the first exemplary embodiment has a linear boundary 36 extending in the front-rear direction through the middle as viewed in the left-right direction. A left grid region 38 serving as an example of a first region is formed to the left of the boundary 36. The left grid region 38 has elongate hexagonal holes 37 serving as an example of holes with a predetermined shape and arranged at a first inclination angle 01 inclined relative to the front-rear direction so as to extend over a plane. A right grid region 39 serving as an example of a second region is formed to the right of the boundary 36. The right grid region 39 has elongate hexagonal holes 37 arranged at a second inclination angle θ2 different from the first inclination angle θ1 so as to extend over a plane.

In the first exemplary embodiment, the left grid region 38 and the right grid region 39 both have the elongate hexagonal holes 37 with the same shape, and have margins 40 that surround the holes 37.

In the left grid region 38 in the first exemplary embodiment, the inclination angle θ1 is defined as an angle formed between a line 44*b* and the outbound direction of the reciprocating electrode cleaner 16 during the cleaning operation, that is, a forward direction 45 in the first exemplary embodiment. Specifically, with the center of gravity of a reference hole 37 being defined as 41 and lines that connect centers 42*a*, 43*a*, and 44*a* of gravity of neighboring holes 42, 43, and 44 being defined as 42*b*, 43*b*, and 44*b*, respectively, the line 44*b* that connects the center 44*a* of gravity farthest from the center 41 to the center of gravity 41 is selected.

The inclination angle θ2 in the right grid region 39 is similar to the inclination angle θ1 in the left grid region 38 except for the fact that they are bilaterally symmetric.

In the first exemplary embodiment, the boundary 36 is disposed at an intermediate position in the left-right direction relative to the first wire 11*a* and the second wire 11*b*, such that the left grid region 38 is disposed in correspondence with the first wire 11*a*, and the right grid region 39 is disposed in correspondence with the second wire 11*b*.

Furthermore, as shown in FIG. 9, in the grid electrode 12 in the first exemplary embodiment, the first inclination angle θ1 and the second inclination angle θ2 are inclined away from each other with increasing distance in the forward direction, which is the outbound direction of the electrode cleaner 16.

Referring to FIGS. 8 and 9, in the grid electrode 12 in the first exemplary embodiment, if the left grid region 38 is symmetrically projected onto the right grid region 39 with respect to the boundary 36, the holes 37 in the left grid region 38 and the holes 37 in the right grid region 39 are not positionally aligned with each other. Specifically, the arrangement pattern of the holes 37 in the left grid region 38 and the arrangement pattern of the holes 37 in the right grid region 39 are asymmetric with respect to the boundary 36 as a symmetry axis.

In the grid electrode 12 in the first exemplary embodiment, the first inclination angle θ1 and the second inclination angle θ2 are inclined away from each other with the boundary 36 interposed therebetween, and absolute values of the angles θ1 and θ2 are set substantially equal to each other. Specifically, in the first exemplary embodiment, the arrangement patterns of the holes 37 are line-symmetric between the left grid region 38 and the right grid region 39, such that the arrangement pattern of the left grid region 38 is displaced relative to the arrangement pattern of the right grid region 39 in the front-rear direction, which is the extending direction of the boundary 36.

Furthermore, in the grid electrode 12 in the first exemplary embodiment, some of the holes 37 that are adjacent to the boundary 36 are deficient holes 37*a* and 37*b*, as compared with the holes 37 located distant from the boundary 36. With regard to such holes 37*a* and 37*b*, the joint areas between the margins of the holes 37*a* and 37*b* and the boundary 36 are sometimes narrow. This tends to cause the bristles of the brush-like grid cleaner 20 to get caught in the holes 37*a* and 37*b* and fall out when the grid cleaner 20 passes therethrough. In light of this, among the deficient holes 37*a* and 37*b*, the holes 37*b* that have a smaller opening area than a predetermined opening area for the holes 37*a* and 37*b* are closed since the bristles may easily get caught in the holes 37*b*. In the first exemplary embodiment, for example, a hole is closed if the opening area thereof is smaller than or equal to 20% of that of a non-deficient hole 37. Alternatively, a hole may be closed if an opening width thereof is smaller than or equal to a specific width (e.g., 0.1 mm).

With regard to each of the deficient and unclosed holes 37*a*, the bristles of the grid cleaner 20 may get readily caught in an area where the margin 40 and the boundary 36 form a sharp angle at the rear end of the hole 37*a*, that is, at the downstream side thereof during the homebound process of the electrode cleaner 16, causing the bristles to fall out. Therefore, in the grid electrode 12 in the first exemplary embodiment, each sharp-angled area 37*d* is partly closed so as to eliminate the sharp angle.

Referring to FIG. 9, in the first exemplary embodiment, the arrangement pattern of the holes 37 in the left grid region 38 and the arrangement pattern of the holes 37 in the right grid region 39 are displaced relative to each other in the front-rear direction, such that at least the closed holes 37*b* in the left grid region 38 and the closed holes 37*b* in the right grid region 39 are displaced relative to each other in the front-rear direction so as not to be disposed adjacent to each other across the boundary 36.

In the first exemplary embodiment, the left grid region 38 and the right grid region 39 have identical periodically-repeating grid patterns, and also have the deficient holes 37*a* and 37*b* that are periodically disposed along the boundary 36. Furthermore, in the first exemplary embodiment, a hole having an opening area that is smaller than or equal to 20% of that of a non-deficient hole 37 is closed. Therefore, the holes 37 include entirely closed holes 37*b* and holes 37*a* in which only the sharp-angled areas 37*d* are closed. Although it may be desirable that all of the closed holes 37*b* in the left grid region 38 and all of the closed holes 37*b* in the right grid region 39 be arranged such that they do not overlap each other, it may sometimes be difficult to arrange all of the closed holes without overlapping them if there are many closed areas or in view of design flexibility of the grid pattern. Therefore, in view of design flexibility and unevenness prevention, it may be desirable that all of the holes 37, 37*a*, and 37*b* be arranged such that at least the closed holes 37*b* do not overlap each other across the boundary 36. Specifically, examples of the arrangement patterns include an arrangement pattern in which the closed holes 37*b* and the holes 37*a* with the closed sharp-angled areas 37*d* overlap each other across the boundary 36, an arrangement pattern in which the holes 37*a* with the closed sharp-angled areas 37*d* overlap each other across the boundary 36, and an arrangement pattern in which identical closed holes 37*b* do not overlap each other in a line-symmetric fashion.

Operation of First Exemplary Embodiment

In the image forming apparatus U according to the first exemplary embodiment of the present invention having the above-described configuration, when voltage is applied to the wire electrodes 11 and the electrode members 2+12 opposed thereto, electrons are released from the wires 11*a* and 11*b*, whereby the surfaces of the photoconductor drums Py to Pk are electrostatically charged.

In the first exemplary embodiment, the left grid region 38 and the right grid region 39 have asymmetric arrangement patterns with respect to a line, so that the occurrence of uneven charge distribution in the axial direction of each of the photoconductor drums Py to Pk, that is, the main scanning direction, is reduced, as compared with a case where the left grid region 38 and the right grid region 39 are disposed symmetrically with respect to a line.

Figure 10A:
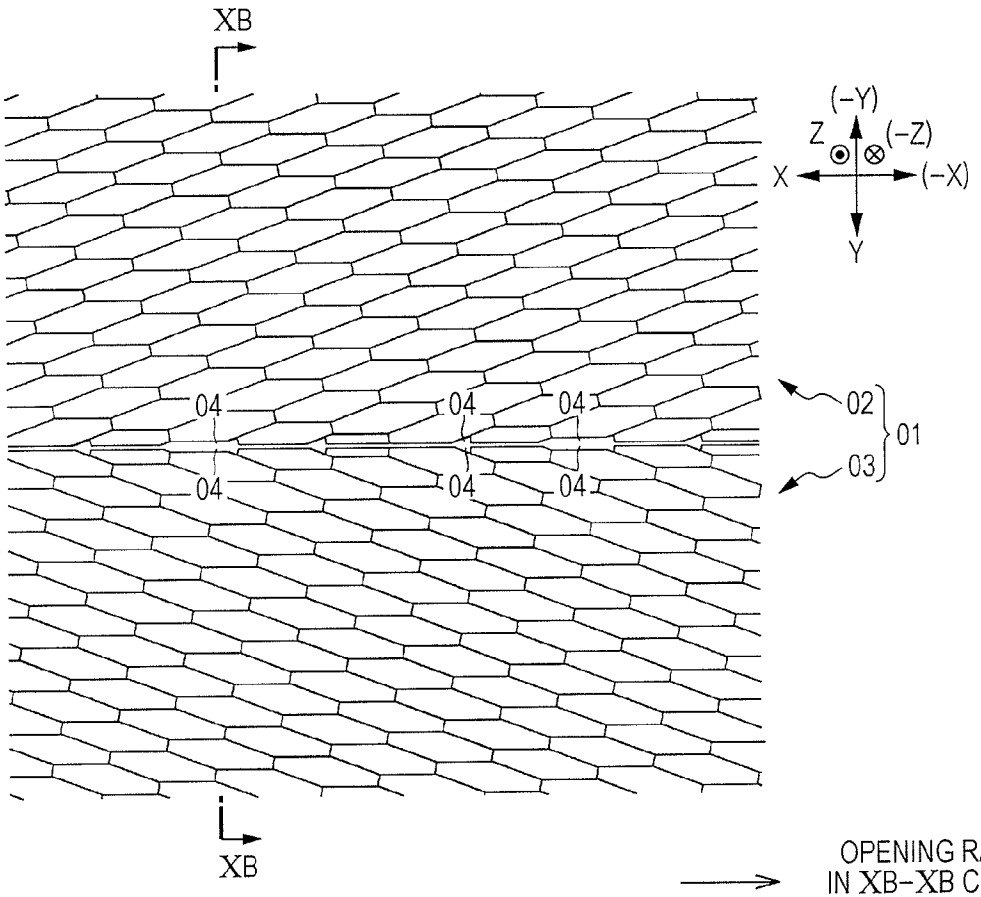
FIGS. 10A and 10B illustrate a grid electrode of a comparative example, FIG. 10A illustrating a state where a left grid region and a right grid region are disposed symmetrically with respect to a line, FIG. 10B being a cross-sectional view taken along line XB-XB in FIG. 10A.
Figure 10B:
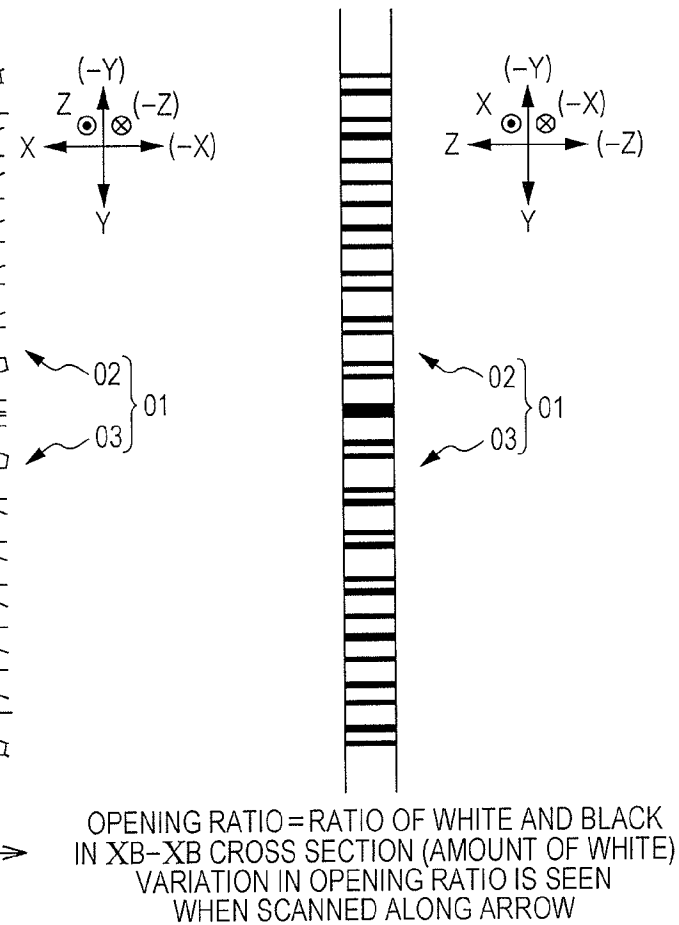

FIGS. 10A and 10B illustrate a grid electrode of a comparative example. Specifically, FIG. 10A illustrates a state where a left grid region and a right grid region are disposed symmetrically with respect to a line, and FIG. 10B is a cross-sectional view taken along line XB-XB in FIG. 10A.

Referring to FIG. 10A, in a grid electrode 01 of a comparative example, a left grid region 02 and a right grid region 03 are disposed symmetrically with respect to a line.

The grid electrode 12 in the first exemplary embodiment and the grid electrode 01 of the comparative example shown in FIG. 10A both have holes 37 that are arranged in a predetermined pattern. Therefore, in view of (opening ratio)=(sum of opening area)/(overall area) in a cross section taken in the sub scanning direction, as in the cross-sectional view taken along line XB-XB in FIG. 10A, the opening ratio varies periodically in the main scanning direction.

In this case, in the grid electrode 01 of the comparative example having line-symmetric arrangement patterns as shown in FIG. 10A, the opening ratio in the right grid region 03 is large when the opening ratio is large in the left grid region 02, whereas the opening ratio in the right grid region 03 is small when the opening ratio is small in the left grid region 02. Therefore, a variation in the opening ratio is doubled by the left grid region 02 and the right grid region 03.

In particular, if holes 04 with a small opening area are to be closed, the closed holes 04 would be disposed adjacent to each other across the boundary, resulting in a reduced opening ratio in the sub scanning direction.

Although it is conceivable to reduce the variation in the opening ratio by increasing the thickness of the boundary 36, the boundary 36 with an increased thickness would block the electric discharge, resulting in reduced charging efficiency for each of the photoconductor drums Py to Pk. For this reason, it may be desirable to minimize the thickness of the boundary 36. However, reducing the thickness of the boundary 36 would cause the opening ratio to vary easily.

Figure 11:
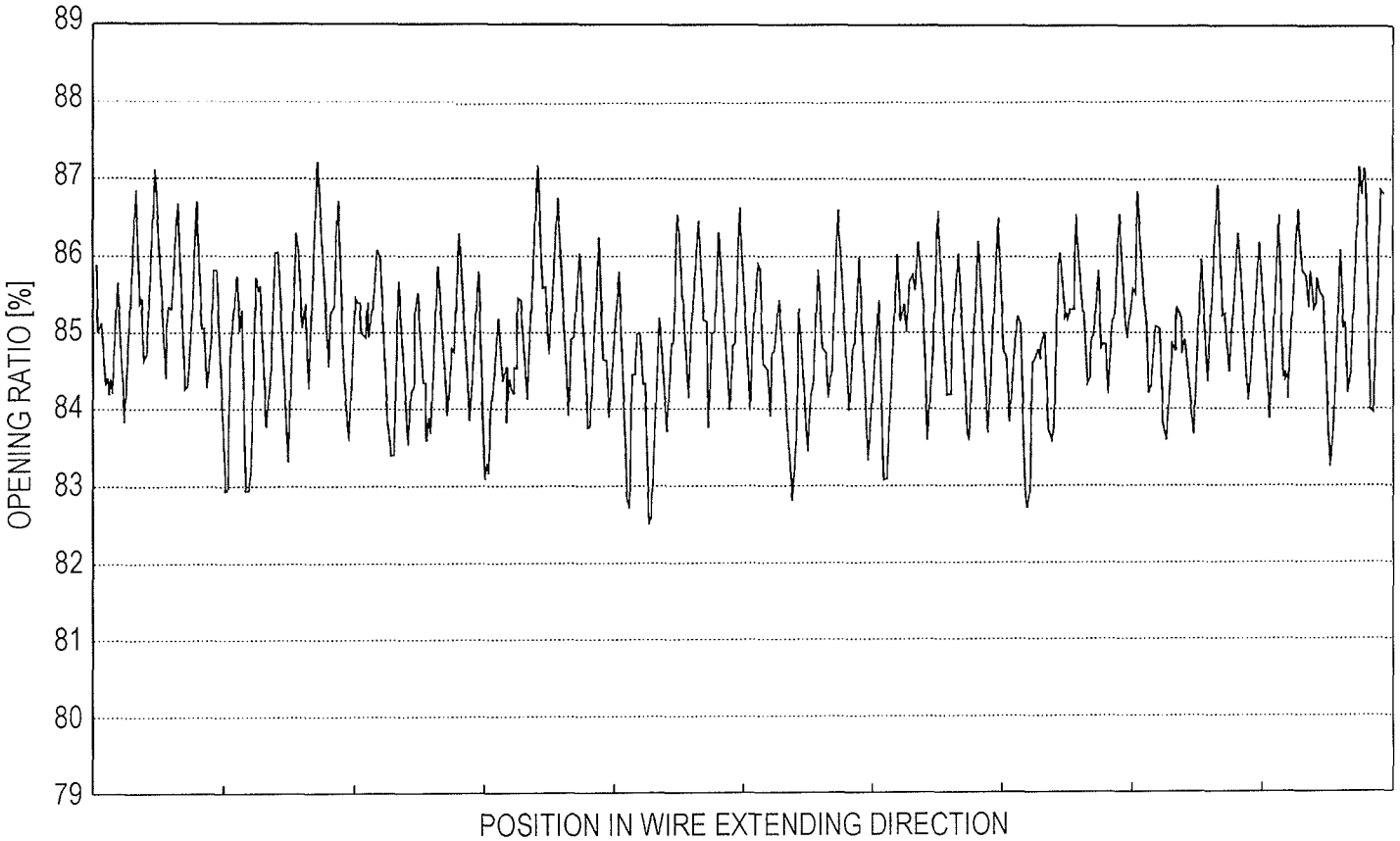
FIG. 11 illustrates the opening ratio of the grid electrode in the first exemplary embodiment, showing a graph having an abscissa denoting the position in the wire extending direction and an ordinate denoting the opening ratio.

FIG. 11 illustrates the opening ratio of the grid electrode in the first exemplary embodiment, showing a graph having an abscissa denoting the position in the wire extending direction and an ordinate denoting the opening ratio.

Figure 12:
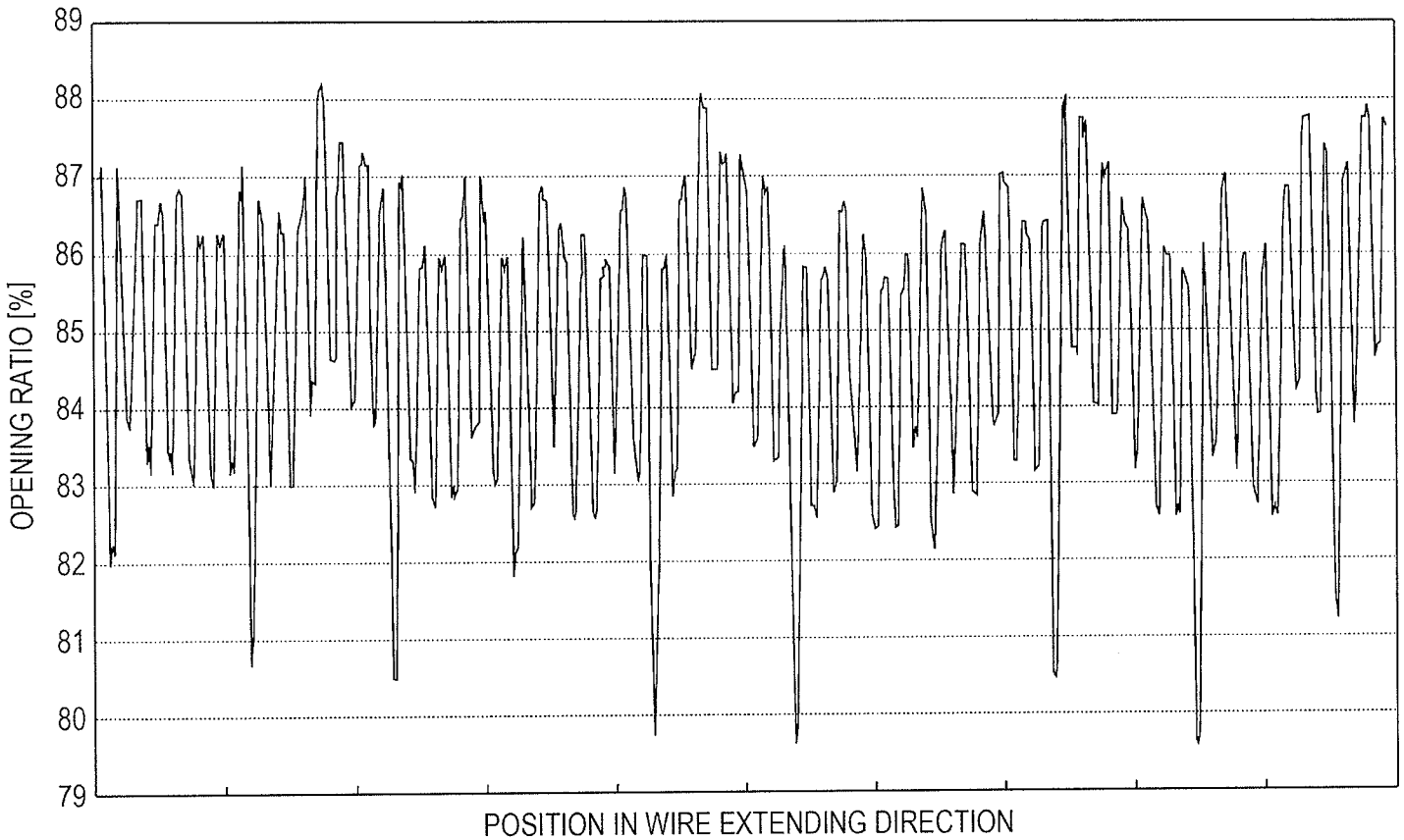
FIG. 12 illustrates the opening ratio of the grid electrode in the comparative example, showing a graph having an abscissa denoting the position in the wire extending direction and an ordinate denoting the opening ratio.

FIG. 12 illustrates the opening ratio of the grid electrode of the comparative example, showing a graph having an abscissa denoting the position in the wire extending direction and an ordinate denoting the opening ratio.

Accordingly, referring to FIGS. 9, 10A, and 10B, when a variation in the opening ratio in the cross section taken in the sub scanning direction is measured in the main scanning direction, the first exemplary embodiment corresponding to the asymmetric arrangement achieves an opening ratio ranging between about 82.5% and 87.2% and a variation in the opening ratio of about 4.7%, as shown in FIG. 11. In contrast, in the configuration shown in FIGS. 10A and 10B corresponding to the symmetric arrangement, the opening ratio ranges between about 79.5% and 88.2%, and a variation in the opening ratio is large at about 8.7%, as shown in FIG. 12. In particular, uneven charge distribution tends to occur since a large variation occurs between a point that falls below an 80% opening ratio and the opposite sides thereof.

Therefore, the configuration of the comparative example with a large variation in the opening ratio in the main scanning direction is problematic in that the opening ratio varies greatly and that uneven charge distribution in the main scanning direction is large on the surfaces of the photoconductor drums Py to Pk. In particular, in the configuration of the comparative example in which the opening ratio varies periodically, uneven charge distribution tends to occur periodically in the main scanning direction, leading to reduced image quality, such as periodical formation of dark and light areas in an image. In contrast, in the first exemplary embodiment, the asymmetric left and right grid regions 38 and 39 allow for a reduced variation in the opening ratio so that the occurrence of uneven charge distribution is reduced, whereby the occurrence of image deterioration is reduced.

In particular, in the first exemplary embodiment, since the closed holes 37*b* are displaced relative to each other in the main scanning direction between the left and right grid regions 38 and 39, a variation in the opening ratio is reduced so that the occurrence of uneven charge distribution is reduced, as compared with a case where the closed areas are disposed adjacent to each other across the boundary 36 even in an asymmetric arrangement or a case where the closed areas partly overlap each other across the boundary 36.

Furthermore, in the first exemplary embodiment, the line-symmetric arrangement patterns of the left grid region 38 and the right grid region 39 are displaced relative to each other in the front-rear direction, and the arrangement patterns may be formed by turning over a single arrangement pattern and then joining identical arrangement patterns together. Therefore, the grid regions 38 and 39 may be formed using a single component so as to allow for reduced manufacturing costs, as compared with a case where the right grid region 39 and the left grid region 38 are formed by fabricating grid segments with different grid patterns individually and then joining them together.

Moreover, in the first exemplary embodiment, when the electrode cleaner 16 reciprocates, the brush-like grid cleaner 20 removes the contamination, such as a discharge product, from the surface of the grid electrode 12. The removed contamination may adhere to the grid cleaner 20 or fall onto the surface of the photoconductor drum Py to Pk. In this case, in the first exemplary embodiment, the ventilator is activated while the electrode cleaner 16 reciprocates, so that the contamination falling or fallen onto the photoconductor drum Pk to Pk is collected after being ejected outward with air. Therefore, the occurrence of a charge defect caused by contamination adhered to the surfaces of the photoconductor drums Py to Pk is reduced.

In particular, in the case where the brush-like grid cleaner 20 is used, the bristles of the brush may get caught at the margins 40 of the holes 37 and fall out. If the bristles of the brush adhere to the surface of each of the photoconductor drums Py to Pk, image deterioration may possibly occur. However, in the first exemplary embodiment, the holes 37*b* with a small opening area where the bristles can get easily caught are closed so as to reduce the possibility of the bristles of the brush falling out. In addition, an exhaust process is performed during the cleaning operation so that the fallen bristles of the brush may be readily collected.

Figure 13A:
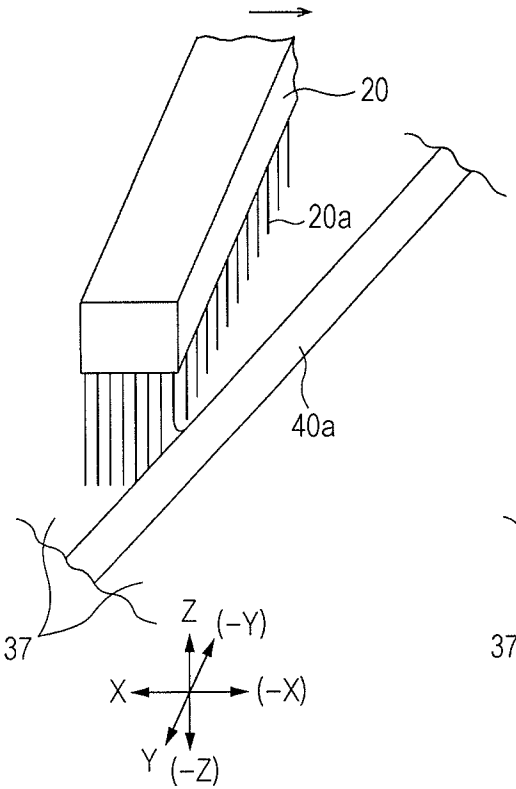
FIGS. 13A to 13C illustrate the operation of the first exemplary embodiment, FIG. 13A illustrating a state where bristles of a grid cleaner are being brought into contact with a margin, FIG. 13B illustrating a state where the grid cleaner is moved toward a home position from the state shown in FIG. 13A, FIG. 13C illustrating a state where the grid cleaner is moved further toward the home position from the state shown in FIG. 13B.
Figure 13B:
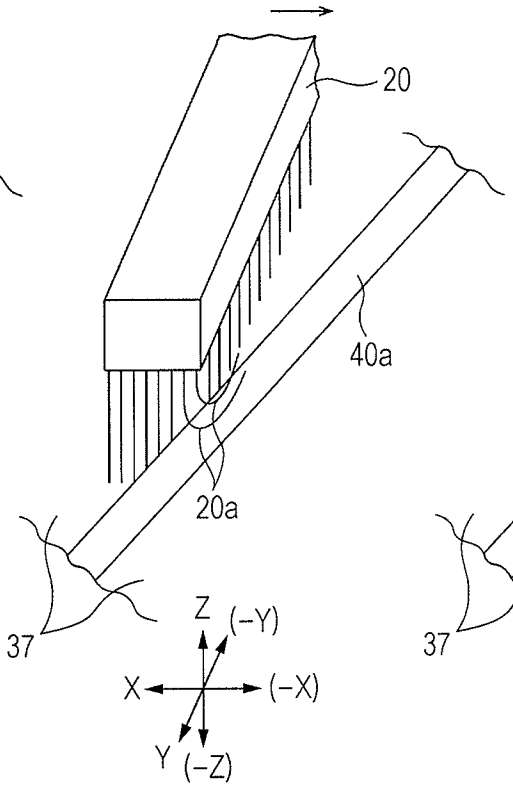
Figure 13C:
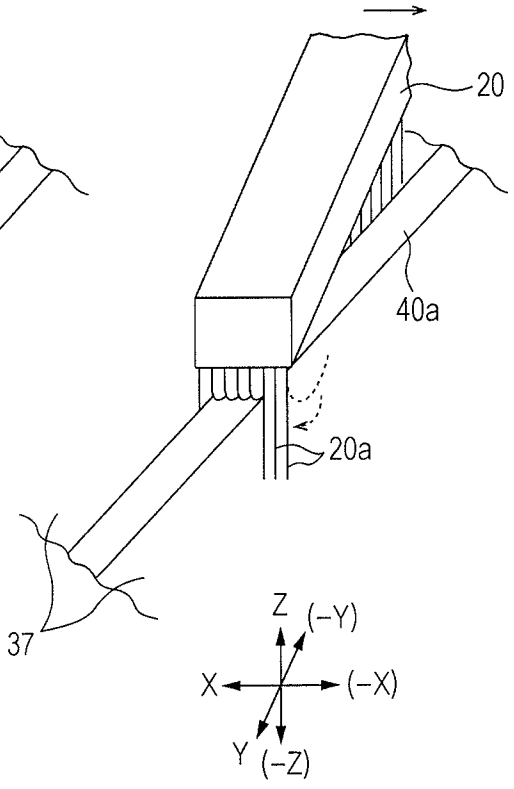

FIGS. 13A to 13C illustrate the operation of the first exemplary embodiment. Specifically, FIG. 13A illustrates a state where the bristles of the grid cleaner 20 are being brought into contact with the one of the margins 40, FIG. 13B illustrates a state where the grid cleaner 20 is moved toward the home position from the state shown in FIG. 13A, and FIG. 13C illustrates a state where the grid cleaner 20 is moved further toward the home position from the state shown in FIG. 13B.

Furthermore, in the first exemplary embodiment, the inclination angles θ1 and θ2 are set so as to be inclined outward with increasing distance in the forward direction, that is, toward the downstream side in the outbound direction of the electrode cleaner 16. Specifically, the angles are set such that the arrangement patterns of the holes 37 spread away from each other with increasing distance in the forward direction. Therefore, with regard to the right grid region 39 in FIGS. 9 and 13A to 13C, when bristles 20*a* of the brush-like grid cleaner 20 come into contact with a margin 40*a* that is located at the rear side thereof, which is the downstream side in the homebound process, and that is inclined relative to the homebound direction, the bristles 20*a* bend inward, as shown in FIGS. 13A and 13B. When the grid cleaner 20 moves in the homebound direction toward the home position from the state shown in FIGS. 13A and 13B, the bristles 20*a* move over the margin 40*a*, as shown in FIG. 13C, whereby the bristles 20*a* bend outward so as to elastically restore the original shape. Specifically, when the bristles 20*a* move over the margin 40*a*, the bristles 20*a* elastically deform outward from the inner side.

In particular, in the configuration in which the electrode cleaner 16 reciprocates, the bristles 20*a* of the brush may readily scrape off the contamination during the outbound process so that the contamination may often be removed during the homebound process. In actuality, it is confirmed by the present inventors that a larger amount of contamination falls onto the surfaces of the photoconductor drums Py to Pk during the homebound process.

In a case where the inclination angles θ1 and θ2 are inclined inward with increasing distance in the forward direction, the bristles of the brush would be elastically deformed inward during the homebound process. This would cause the contamination adhered to the bristles of the brush to be flicked so as to become concentrated toward the center from both sides in the sub scanning direction. When the contamination is concentrated toward the center, the contamination cannot be sufficiently drawn in only by the suction of air. This causes the contamination to exist locally in certain areas on the surfaces of the photoconductor drums Py to Pk, and the time required for the photoconductor cleaners Cly to CLk to remove the contamination increases, possibly resulting in reduced image quality.

In contrast, in the first exemplary embodiment, the bristles 20*a* are elastically deformed outward during the homebound process so that the contamination is readily dispersed outward. Therefore, the contamination may be sufficiently drawn in by the suction of air, so that the contamination adhered to the surfaces of the photoconductor drums Py to Pk may also be readily dispersed, thereby effacing image deterioration.

The brush used for the grid cleaner 20 is generally formed by cutting a long pile-sheet brush, which has bristles in the form of piles on long sheet-like base fabric, into short segments in accordance with the size of the grid cleaner 20. Therefore, it is known that the bristles at the cut ends may readily fall out from the base fabric. Although the ends may be given a thermal treatment or an adhesive treatment to prevent the bristles from falling out, such a treatment leads to an increase in costs. For this reason, it is confirmed that the bristles may fall out during the reciprocation of the electrode cleaner 16 and remain on the grid electrode 12, leading to uneven charge distribution. The bristles often get caught in areas where the holes 37 in the grid are narrow, but are unlikely to get caught in wide areas. Moreover, even when detached bristles get caught in the narrow areas, these bristles may sometimes be removed when the grid cleaner 20 is moved again since the brush comes into contact again with the detached bristles caught in the narrow areas.

Based on experiments performed by the present inventors for reducing the number of falling bristles, it is confirmed that the number of falling bristles is reduced by disposing the grid such that the brush is located toward the center during the homebound process. Specifically, when the brush expands during the outbound process by coming into contact with the margins 40 extending at the inclination angles θ1 and θ2, the bristles 20*a* of the brush approach the periphery (i.e., the outer frame segment 12*b*) of the grid electrode 12. Therefore, since the holes 37 along the periphery are deficient and narrow, the bristles 20*a* of the brush may get caught in the sharp-angled areas and readily fall out before the bristles 20*a* move over the margins 40. On the other hand, since the brush moves toward the center during the homebound process, the brush moves away from the periphery. Therefore, the bristles 20*a* are unlikely to fall out since the deficient holes 37*b* are closed and the holes with closed sharp angle areas are widened. In particular, even when the bristles fall out during the outbound process, there is a high possibility that the bristles may be removed during the homebound process. The bristles removed from the grid electrodes 12 fall onto the photoconductor drums Py to Pk and are ejected outward by air suction.

Second Exemplary Embodiment

Figure 14A:
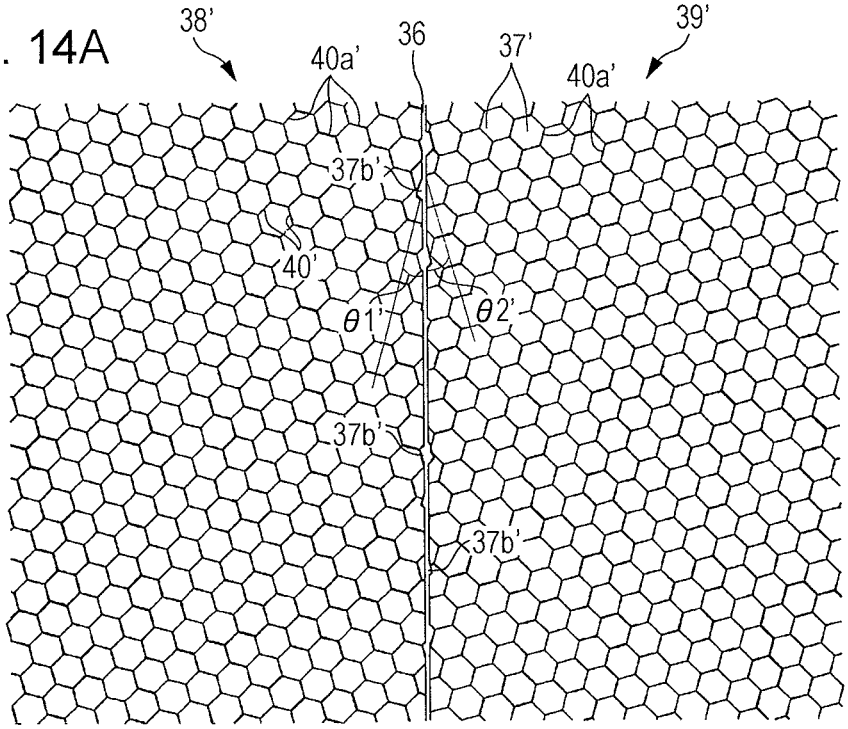
FIGS. 14A and 14B are diagrams for explaining a grid electrode according to a second exemplary embodiment, FIG. 14A being an enlarged view of a relevant part of a grid segment in the second exemplary embodiment corresponding to FIG. 9 in the first exemplary embodiment, FIG. 14B being an enlarged view of a relevant part of a grid segment in a comparative example corresponding to FIG. 10A.
Figure 14B:
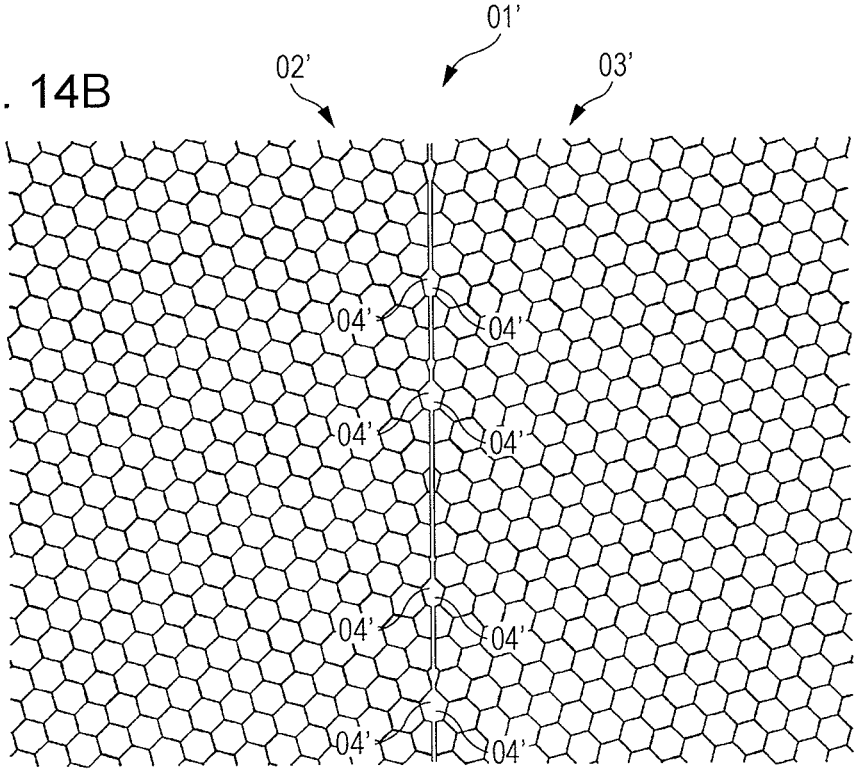

FIGS. 14A and 14B are diagrams for explaining a grid electrode according to a second exemplary embodiment. Specifically, FIG. 14A is an enlarged view of a relevant part of a grid segment in the second exemplary embodiment corresponding to FIG. 9 in the first exemplary embodiment, and FIG. 14B is an enlarged view of a relevant part of a grid segment in a comparative example corresponding to FIG. 10A.

In the following description of the second exemplary embodiment, components that correspond to those in the first exemplary embodiment are given the same reference numerals, and detailed descriptions thereof will be omitted.

The second exemplary embodiment differs from the first exemplary embodiment in the following points, but is similar to the first exemplary embodiment in other points.

Referring to FIG. 14A, the grid electrode 12 in the second exemplary embodiment has holes 37' with a regular hexagonal shape, which is different from the elongate hexagonal holes 37 in the first exemplary embodiment. Similar to the first exemplary embodiment, the regular hexagonal holes 37' in a left grid region 38' and the regular hexagonal holes 37' in a right grid region 39' are arranged in a bilaterally asymmetric manner with respect to a line. Moreover, absolute values of inclination angles θ1' and θ2' are set substantially equal to each other, and holes 37*b'* with a small opening area are closed.

Operation of Second Exemplary Embodiment

In the chargers CCy to CCk in the second exemplary embodiment having the above-described configuration, a variation in the opening ratio in the main scanning direction is reduced, as compared with the bilaterally symmetric configuration of the comparative example as shown in FIG. 14B, thereby reducing the occurrence of uneven charge distribution in the main scanning direction as in the first exemplary embodiment.

Third Exemplary Embodiment

Figure 15A:
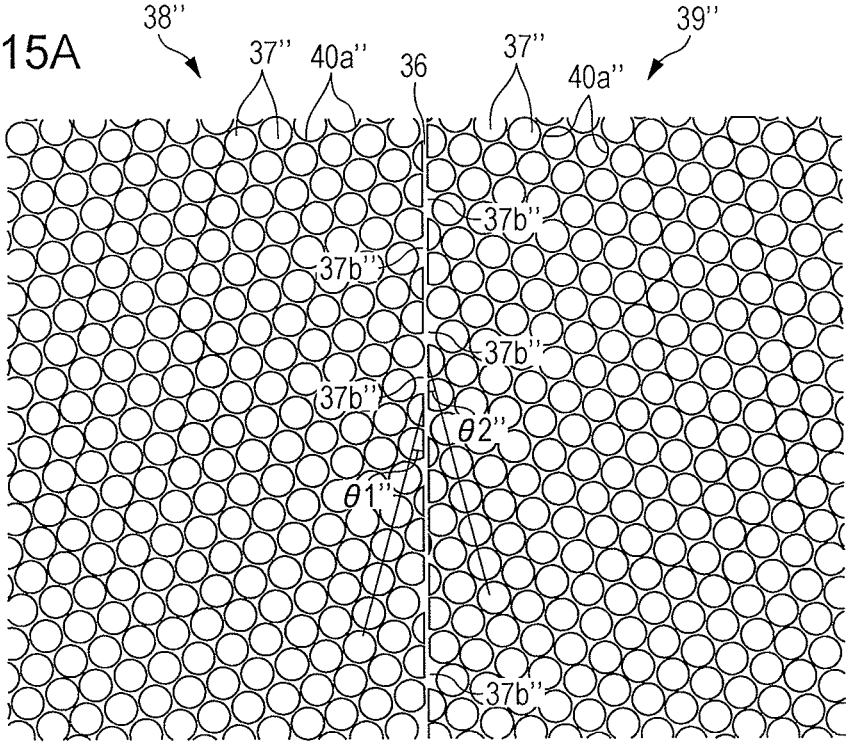
FIGS. 15A and 15B are diagrams for explaining a grid electrode according to a third exemplary embodiment, FIG. 15A being an enlarged view of a relevant part of a grid segment in the third exemplary embodiment corresponding to FIG. 9 in the first exemplary embodiment, FIG. 15B being an enlarged view of a relevant part of a grid segment in a comparative example corresponding to FIG. 10A.
Figure 15B:
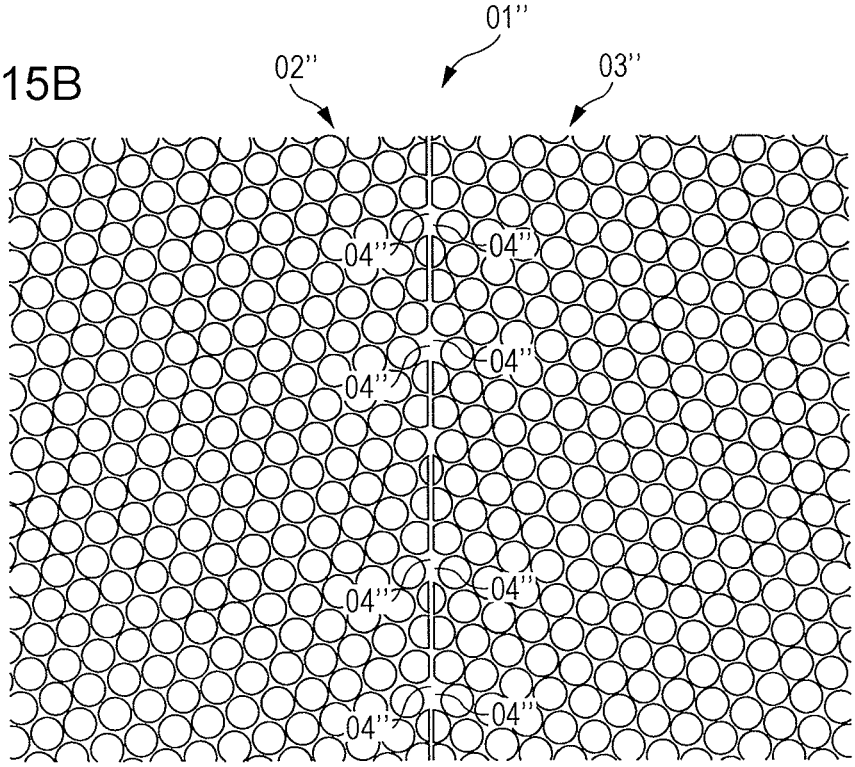

FIGS. 15A and 15B are diagrams for explaining a grid electrode according to a third exemplary embodiment. Specifically, FIG. 15A is an enlarged view of a relevant part of a grid segment in the third exemplary embodiment corresponding to FIG. 9 in the first exemplary embodiment, and FIG. 15B is an enlarged view of a relevant part of a grid segment in a comparative example corresponding to FIG. 10A.

In the following description of the third exemplary embodiment, components that correspond to those in the first exemplary embodiment are given the same reference numerals, and detailed descriptions thereof will be omitted.

The third exemplary embodiment differs from the first exemplary embodiment in the following points, but is similar to the first exemplary embodiment in other points.

Referring to FIG. 15A, the grid electrode 12 in the third exemplary embodiment has holes 37" with a circular shape, which is different from the elongate hexagonal holes 37 in the first exemplary embodiment. Similar to the first exemplary embodiment, the circular holes 37" in a left grid region 38" and the circular holes 37" in a right grid region 39" are arranged in a bilaterally asymmetric manner with respect to a line. Moreover, absolute values of inclination angles θ1" and θ2" are set substantially equal to each other, and holes 37*b"* with a small opening area are closed.

Operation of Third Exemplary Embodiment

In the chargers CCy to CCk in the third exemplary embodiment having the above-described configuration, a variation in the opening ratio in the main scanning direction is reduced, as compared with the bilaterally symmetric configuration of the comparative example as shown in FIG. 15B, thereby reducing the occurrence of uneven charge distribution in the main scanning direction as in the first and second exemplary embodiments.

Modifications

Although the exemplary embodiments of the present invention have been described in detail above, the present invention is not to be limited to the above exemplary embodiments and permits various modifications within the scope of the invention defined in the claims. Modifications H01 to H014 of the above exemplary embodiments of the present invention will be described below.

In a first modification H01 of the above exemplary embodiments, the image forming apparatus U is not limited to a copier, but may be applied to other types of image forming apparatuses, such as a printer or a facsimile apparatus. Furthermore, the above exemplary embodiments are not limited to a color image forming apparatus, but may be applied to a monochrome image forming apparatus. Furthermore, the above exemplary embodiments are not limited to a tandem-type image forming apparatus, but may be applied to a rotary-type image forming apparatus.

In a second modification H02, although the wire electrode 11 is constituted of two wires in the above exemplary embodiments, the wire electrode 11 may be constituted of a single wire or three or more wires. Furthermore, the grid electrode 12 is not limited to two regions, i.e., the left grid region 38, 38', 38" and the right grid region 39, 39', 39", but may have three or more regions.

In a third modification H03 of the above exemplary embodiments, the shield electrode 2 may be omitted.

In a fourth modification H04, although the cleaners 22 and 26 are configured to come into and out of contact with the wire electrode 11 in the above exemplary embodiments, the cleaners 22 and 26 may be configured to be constantly in contact with the wire electrode 11.

In a fifth modification H05, although chargers are described as an example of dischargers in the above exemplary embodiments, the transfer units T1*y* to T1*k*, and T2, static eliminators or auxiliary static eliminators for the photoconductor drums Py to Pk and the recording paper S may be used as an example of dischargers.

In a sixth modification H06 of the above exemplary embodiments, the configuration for moving the electrode cleaner 16 in the front-rear direction is not limited to the use of the shaft 6, but may employ a freely-chosen configuration that can move the electrode cleaner 16 in the front-rear direction.

In a seventh modification H07, the positions where the detected sections 21*b* and the optical sensors SN1 are disposed are not limited to those described in the above exemplary embodiments, but may be changed to freely-chosen positions, such as displacing the positions in the front-rear direction or the left-right direction. Furthermore, for example, the detected sections 21*b* may protrude outward from the charger bodies 1, and the optical sensors SN1 may be configured to perform detection by being disposed in the image recording device U3 of the image forming apparatus U or in the corresponding photoconductor drums Py to Pk, instead of being disposed in the corresponding chargers CCy to CCk.

In an eighth modification H08, the configuration of the grid cleaner 20 is not limited to that described in the above exemplary embodiments, but a freely-chosen configuration may be employed in accordance with the design. For example, the brush or cloth may be changed to a freely-chosen cleaning member, such as a sponge. Furthermore, a cleaning member that is contactable with the inner surface of the shield electrode 2 may be provided so that the shield electrode 2 may also be cleaned, or a cleaning member that is contactable with the lower surface of the grid electrode 12 may be provided so that both surfaces of the grid electrode 12 may be cleaned.

In a ninth modification H09, although the left grid region 38, 38', 38" and the right grid region 39, 39', 39" have bilaterally symmetric arrangement patterns that are displaced relative to each other in the main scanning direction in the above exemplary embodiments, the arrangement patterns themselves may be bilaterally asymmetric with respect to a line. For example, a freely-chosen combination of the left and right grid regions, such as a combination of the left grid region 38' in the second exemplary embodiment and the right grid region 39' in the third exemplary embodiment, may be used.

In a tenth modification H010, although the absolute values of the inclination angles θ1 and θ2 are substantially equal to each other between the left grid region 38, 38', 38" and the right grid region 39, 39', 39" in the above exemplary embodiments, an alternative configuration with different absolute values is also possible.

In an eleventh modification H011, although the inclination angles θ1 and θ2 may be inclined outward with increasing distance in the outbound direction of the electrode cleaner 16 in the above exemplary embodiments, the inclination angles θ1 and θ2 may alternatively be inclined inward.

In a twelfth modification H012, although the holes 37*b* may be closed in the above exemplary embodiments, a configuration in which the holes 37*b* are not closed is also possible.

In a thirteenth modification H013, although the air suction process may be performed during the movement of the electrode cleaner 16, that is, during the cleaning operation, in the above exemplary embodiments, a configuration in which the air suction process is not performed is also possible. Furthermore, for example, the photoconductor drums Py to Pk may be rotated, that is, idly rotated, during the cleaning operation so as to prevent the contamination from falling onto specific positions on the surfaces of the photoconductor drums Py to Pk, and the idle rotation process and the air suction process may be performed in combination with each other.

In a fourteenth modification H014, the shapes of the holes 37, 37', 37" are not limited to those described in the above exemplary embodiments, and may be a freely-chosen shape. Examples of the shapes may include a polygonal shape, such as a regular hexagonal shape, a triangular shape, a rectangular shape, and a pentagonal shape, a combination of polygonal shapes, such as a combination of a pentagonal shape and a hexagonal shape, and a combination of a polygonal shape and a circular shape.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A discharger comprising:

a discharging member that is disposed facing a member to be charged and that discharges electricity by applying voltage thereto; and a grid member that is disposed between the discharging member and the member to be charged and regulates electric discharge from the discharging member when voltage is applied between the grid member and the discharging member, the grid member having a plurality of holes with a predetermined shape, the holes extending through the grid member from the discharging member toward the member to be charged, wherein the grid member has a first region, a second region, and a boundary disposed between the first region and the second region and extending in an extending direction of the discharging member, the first region having the holes with the predetermined shape arranged at a first inclination angle inclined at an acute angle with respect to the boundary in the extending direction, the second region having the holes with the predetermined shape arranged at a second inclination angle inclined at an acute angle with respect to the boundary in the extending direction, the second inclination angle being different from the first inclination angle, wherein when the first region is symmetrically projected onto the second region with respect to the boundary, an arrangement pattern of the holes in the first region and an arrangement pattern of the holes in the second region are positionally displaced relative to each other, wherein the extending direction is a one-way direction.

2. The discharger according to claim 1, wherein the first inclination angle relative to the extending direction of the discharging member and the second inclination angle relative to the extending direction of the discharging member are inclined in opposite directions from each other with the extending direction of the discharging member therebetween, and absolute values of the first inclination angle and the second inclination angle are set substantially equal to each other.

3. The discharger according to claim 2, wherein the holes include deficient holes that are disposed adjacent to the boundary and non-deficient holes that are disposed distant from the boundary, wherein some of the deficient holes are closed, and wherein an area corresponding the closed holes in the first region and an area corresponding to the closed holes in the second region are displaced relative to each other in the extending direction of the discharging member.

4. The discharger according to claim 3, further comprising a cleaning member that is supported in a movable manner in the extending direction of the discharging member, the cleaning member reciprocating in the extending direction of the discharging member from a predetermined initial position, which is located at one end in the extending direction of the discharging member, while being in contact with the grid member so as to clean the grid member, wherein the first inclination angle and the second inclination angle are inclined away from each other with increasing distance in an outbound direction of the cleaning member.

5. The discharger according to claim 2, further comprising a cleaning member that is supported in a movable manner in the extending direction of the discharging member, the cleaning member reciprocating in the extending direction of the discharging member from a predetermined initial position, which is located at one end in the extending direction of the discharging member, while being in contact with the grid member so as to clean the grid member, wherein the first inclination angle and the second inclination angle are inclined away from each other with increasing distance in an outbound direction of the cleaning member.

6. The discharger according to claim 1, wherein the holes include deficient holes that are disposed adjacent to the boundary and non-deficient holes that are disposed distant from the boundary, wherein some of the deficient holes are closed, and wherein an area corresponding the closed holes in the first region and an area corresponding to the closed holes in the second region are displaced relative to each other in the extending direction of the discharging member.

7. The discharger according to claim 6, further comprising a cleaning member that is supported in a movable manner in the extending direction of the discharging member, the cleaning member reciprocating in the extending direction of the discharging member from a predetermined initial position, which is located at one end in the extending direction of the discharging member, while being in contact with the grid member so as to clean the grid member, wherein the first inclination angle and the second inclination angle are inclined away from each other with increasing distance in an outbound direction of the cleaning member.

8. The discharger according to claim 1, further comprising a cleaning member that is supported in a movable manner in the extending direction of the discharging member, the cleaning member reciprocating in the extending direction of the discharging member from a predetermined initial position, which is located at one end in the extending direction of the discharging member, while being in contact with the grid member so as to clean the grid member, wherein the first inclination angle and the second inclination angle are inclined away from each other with increasing distance in an outbound direction of the cleaning member.

9. The discharger according to claim 8, further comprising an ejecting unit that draws in contamination, which is removed from the grid member by the cleaning member, by suction and ejects the contamination outward, the contamination being ejected outward by performing an air suction process while the cleaning member reciprocates.

10. An image forming apparatus comprising:

an image bearing member as a member to be charged; and a charger that includes the discharger according to claim 1 and that electrostatically charges a surface of the image bearing member.

11. The discharger according to claim 1, wherein the extending direction is an outbound direction of a reciprocating electrode cleaner during a cleaning operation.

12. A discharger comprising:

a discharging member that is disposed facing a member to be charged and discharges electricity by applying voltage thereto; and a grid member that is disposed between the discharging member and the member to be charged and regulates electric discharge from the discharging member when voltage is applied between the grid member and the discharging member, the grid member having a plurality of holes with a predetermined shape, the holes extending through the grid member from the discharging member toward the member to be charged, wherein the grid member has a first region in which the holes are arranged at a first inclination angle inclined relative to an extending direction of the discharging member, a second region in which the holes are arranged at a second inclination angle that is different from the first inclination angle, and a boundary disposed between the first region and the second region and extending in the extending direction of the discharging member, wherein when the first region is symmetrically projected onto the second region with respect to the boundary, an arrangement pattern of the holes in the first region and an arrangement pattern of the holes in the second region are positionally displaced relative to each other, and wherein, when the first region, which is symmetrically projected onto the second region with respect to the boundary, is moved in the extending direction of the discharging member, an arrangement pattern of the holes in the first region matches an arrangement pattern of the holes in the second region.

13. The discharger according to claim 12, wherein the first inclination angle relative to the extending direction of the discharging member and the second inclination angle relative to the extending direction of the discharging member are inclined in opposite directions from each other with the extending direction of the discharging member therebetween, and absolute values of the first inclination angle and the second inclination angle are set substantially equal to each other.

14. The discharger according to claim 13, wherein the holes include deficient holes that are disposed adjacent to the boundary and non-deficient holes that are disposed distant from the boundary, wherein some of the deficient holes are closed, and wherein an area corresponding the closed holes in the first region and an area corresponding to the closed holes in the second region are displaced relative to each other in the extending direction of the discharging member.

15. The discharger according to claim 14, further comprising a cleaning member that is supported in a movable manner in the extending direction of the discharging member, the cleaning member reciprocating in the extending direction of the discharging member from a predetermined initial position, which is located at one end in the extending direction of the discharging member, while being in contact with the grid member so as to clean the grid member, wherein the first inclination angle and the second inclination angle are inclined away from each other with increasing distance in an outbound direction of the cleaning member.

16. The discharger according to claim 13, further comprising a cleaning member that is supported in a movable manner in the extending direction of the discharging member, the cleaning member reciprocating in the extending direction of the discharging member from a predetermined initial position, which is located at one end in the extending direction of the discharging member, while being in contact with the grid member so as to clean the grid member, wherein the first inclination angle and the second inclination angle are inclined away from each other with increasing distance in an outbound direction of the cleaning member.

17. The discharger according to claim 12, wherein the holes include deficient holes that are disposed adjacent to the boundary and non-deficient holes that are disposed distant from the boundary, wherein some of the deficient holes are closed, and wherein an area corresponding the closed holes in the first region and an area corresponding to the closed holes in the second region are displaced relative to each other in the extending direction of the discharging member.

18. The discharger according to claim 17, further comprising a cleaning member that is supported in a movable manner in the extending direction of the discharging member, the cleaning member reciprocating in the extending direction of the discharging member from a predetermined initial position, which is located at one end in the extending direction of the discharging member, while being in contact with the grid member so as to clean the grid member, wherein the first inclination angle and the second inclination angle are inclined away from each other with increasing distance in an outbound direction of the cleaning member.

19. The discharger according to claim 12, further comprising a cleaning member that is supported in a movable manner in the extending direction of the discharging member, the cleaning member reciprocating in the extending direction of the discharging member from a predetermined initial position, which is located at one end in the extending direction of the discharging member, while being in contact with the grid member so as to clean the grid member, wherein the first inclination angle and the second inclination angle are inclined away from each other with increasing distance in an outbound direction of the cleaning member.

20. The discharger according to claim 12, wherein the extending direction is an outbound direction of a reciprocating electrode cleaner during a cleaning operation.

* * * * *